US007257351B2

(12) United States Patent
Tachiki et al.

(10) Patent No.: US 7,257,351 B2
(45) Date of Patent: Aug. 14, 2007

(54) DETACHING/ATTACHING MECHANISM AND IMAGE FORMING DEVICE

(75) Inventors: Hiroshi Tachiki, Yamatokoriyama (JP); Masashi Hirai, Katano (JP); Kohichi Yamauchi, Yamatokoriyama (JP); Noritaka Okazaki, Nara (JP); Fumio Shimazu, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 84 days.

(21) Appl. No.: 10/694,748

(22) Filed: Oct. 29, 2003

(65) Prior Publication Data

US 2005/0074259 A1 Apr. 7, 2005

(30) Foreign Application Priority Data

Oct. 30, 2002 (JP) ..... 2002-316666

(51) Int. Cl.
*G03G 21/16* (2006.01)

(52) U.S. Cl. ..... 399/121

(58) Field of Classification Search ..... 399/121, 399/110, 111, 124, 297–299, 302, 303, 306, 399/308

See application file for complete search history.

(56) References Cited

U.S. PATENT DOCUMENTS 5,602,634 A 2/1997 Uchida et al.
6,115,568 A * 9/2000 Sameshima ..... 399/10
6,236,820 B1 5/2001 Nakazato et al.
2002/0021916 A1* 2/2002 Wakana ..... 399/121
2002/0024579 A1 2/2002 Sato et al.
2002/0098009 A1 7/2002 Nakamura et al.

FOREIGN PATENT DOCUMENTS

JP 2-163238 A 6/1990
JP 6-316347 A 11/1994

OTHER PUBLICATIONS

Oki Technical Review, 1998, Oki Electric Industry Co., Ltd. http://www.oki.com/en/otr/html/nf/otr-161-05-tab-1.html.*

* cited by examiner

*Primary Examiner*—David M. Gray
*Assistant Examiner*—Ryan Gleitz
(74) *Attorney, Agent, or Firm*—Birch, Stewart, Kolasch & Birch, LLP

(57) ABSTRACT

Providing a simply-arranged detaching/attaching mechanism and image forming device which allow a transfer supporter device to be detached/attached through a space formed by opening an outer covering, the device includes photosensitive drums, detachable/attachable transfer belt unit, and rail members supporting a transfer belt unit. Each of the rail members includes a rail groove guiding the transfer belt unit, notch and positioning hole determining the position of the transfer belt unit when the belt is in contact with the photosensitive drums, and notch and convex section determining the position of the transfer belt unit when the belt is detached from the photosensitive drums. The transfer belt unit support with respect to the main body of the image forming device, performed by the rail members, is released in response to the action of opening the side cover, so that the transfer belt unit is in a free state.

20 Claims, 24 Drawing Sheets

G-G PARTIAL CROSS SECTION

F-F PARTIAL CROSS SECTION

DETACHING/ATTACHING MECHANISM AND IMAGE FORMING DEVICE

This Nonprovisional application claims priority under 35 U.S.C. § 119(a) on Patent Application No(s). 2002-316666 filed in JAPAN on Oct. 30, 2002, the entire contents of which are hereby incorporated by reference.

FIELD OF THE INVENTION

The present invention relates to a detaching/attaching mechanism provided with a transfer supporter device in which a transfer supporter is stretched, and an image forming device.

BACKGROUND OF THE INVENTION

A transfer supporter device, which is provided in an image forming device and includes a transfer supporter for transferring an image formed on an image supporter to a transported sheet or the transfer supporter itself, typically includes at least two roller members including a drive roller, and a transfer supporter, which is shaped like an endless belt, is stretched between the roller members, allowing the transfer supporter to rotate.

In this transfer supporter device, the drive roller causes the transfer supporter to rotate so that images which have been formed and sheets are transported. As continuously carrying out this operation, problems such as worn-down, fatigue and contamination of the transfer supporter occur so that the performance of the transfer supporter gradually deteriorates.

For this reason, generally the transfer supporter is replaced at predetermined intervals. Although the whole transfer supporter device may be replaced, only the transfer supporter is replaced in many cases. At any rate, to carry out the replacement, one has to draw out the transfer supporter from the inside of the image forming device, and after the replacement, put the supporter back to its original position.

Meanwhile, in an image forming device in which a sheet is provided on a transfer supporter and an image formed on an image supporter is transferred to the sheet, the sheet is supported by the image supporter and the transfer supporter so that the transfer is properly carried out.

Because of this arrangement, when the sheet is stopped on the transfer supporter due to reasons such as sheet jamming during the transportation due to some sort of trouble, the image transfer to the sheet is unlikely to be carried out properly, and hence the sheet on the transfer supporter has to be removed.

However, since it is difficult to remove the sheet when the same is held between the image supporter and the transfer supporter, it is necessary to release either one of the image supporter and the transfer supporter device from the other.

The distance between the released members cannot be long, in consideration of reasons such as the sizes of the image supporter, the transfer supporter, and the image forming device. Thus, the distance is restricted to be very short and hence one can hardly insert one's hand or finger to remove the sheet on the transfer supporter. For this reason, the sheet has typically been removed by drawing out a member, which is either one of the above-mentioned members and provided in the lower side of the image forming device, from the image forming device.

For instance, Japanese Laid-Open Patent Application No. 2-163238 (published on Jun. 22, 1990) discloses an image forming device arranged such that, a transfer supporter device is lowered and released from an image supporter by operating a handle, and then the transfer supporter and an up-and-down mechanism are drawn out altogether.

Also, Japanese Laid-Open Patent Application No. 6-316347 (published on Nov. 15, 1994; corresponding to Japanese Patent No. 2861721, registered on Dec. 11, 1998) discloses an image forming device in which a transfer supporter device is supported by a drawer and allowed to go up and down. In this image forming device, maintenances such as the removal of a jammed sheet, cleaning, and replacement of the transfer supporter device are performed by drawing out the transfer supporter device together with the drawer after causing the transfer supporter device to go down and separate from the image supporter.

Also, Japanese Laid-Open Patent Application No. 2002-214874 (published on Jul. 31, 2002; corresponding to US2002-98009 A1) discloses an image forming device in which, in sync with opening and shutting of outer coverings from a plurality of directions, a transfer belt is caused to separate from a photosensitive drum at the opened side. With this arrangement, one can carry out jam treatment from a suitable direction.

However, the arrangement in Japanese Laid-Open Patent Application No. 2-163238 has such a problem that, when performing jam treatment and maintenances, since the transfer supporter device is caused to go down for a long distance by operating an up-and-down mechanism such as a release lever, a large space and a lift mechanism are required below the image forming device.

According to the arrangement disclosed by Japanese Laid-Open Patent Application No. 6-316347, the image forming device is drawn out together with the drawer so that the volume of the members to be drawn out is significantly large. Further, in this arrangement, it is necessary to operate a member such as a large lever and this requires a large space inside the image forming device, thereby causing the image forming device to be large and heavy.

In the case of a tandem image forming device in which a plurality of image supporters are provided, the length of a transfer supporter device in the direction of the movement of a transfer supporter (i.e. in the direction orthogonal to the axes of roller members supporting the transfer supporter) is longer than the length of the transfer supporter device in the direction of drawing-out. On this account, the diameter of an opening through which a drawer supporting the transfer device has to be very long when the drawer is drawn out in the direction orthogonal to the direction of the movement of the transfer supporter of the transfer supporter device, and hence the strength of the frame of the image forming device tends to decrease from its drawing side.

The more the radius of the opening for replacing units regarding image forming and for maintenance is elongated, the more the strength of the frame of the image forming device decreases. In particular, when the direction of drawing out members such as a unit including the image supporter and a developing unit is identical with the direction of drawing out members for replacing the transfer supporter device and for maintenance, the radius of the opening has to be further elongated, and this causes significant decrease of the strength.

For this reason, it is necessary to provide a reinforcement or increase the thickness of members constituting a frame, resulting the upsizing and weight gain of the device.

According to Japanese Laid-Open Patent Application No. 2002-214874, since outer coverings can be opened and shut from a plurality of directions and a transfer belt is caused to separate from a photosensitive drum at the opened side, it is necessary to adopt a complicated arrangement, and a transfer supporting device including the transfer belt is not completely freed. Thus, it is, for instance, required to cause the transfer supporter device to be completely free when replacing the same.

SUMMARY OF THE INVENTION

In consideration of the above-described problems, the objective of the present invention is to provide a simple detaching/attaching mechanism and image forming device which realize such an arrangement that a transfer supporter device (contacting member) is freely detachable/attachable through a space formed by opening an outer covering.

To achieve this objective, the detaching/attaching mechanism of the present invention, in which a contacting member is supported so as to be detachable/attachable from/to a supporting member, is characterized by comprising: a holding member which supports the contacting member; and a pushing member which pushes the contacting member via the holding member, in a direction toward the supporting member, in order to cause the contacting member to be in touch with the supporting member, by causing the pushing member to move in one direction, support of the contacting member by the holding member being released so that the contacting member is caused to be detached from the supporting member.

According to this arrangement, the contacting member can be easily freed only by causing the pushing member to move in one direction, and this arrangement allows the user to replace the contacting member with ease.

To achieve the foregoing objective, the image forming device of the present invention, comprising: an image supporter on which an image is formed in accordance with image data; and a transfer supporter device including a transfer supporter which is detachable/attachable from/to the image supporter and transfers the image by contacting the image supporter, is characterized in that the transfer supporter device is detached from the image supporter by performing an action of opening a part of an outer covering the image forming device.

According to this arrangement, the action of opening the outer covering causes the transfer supporter device to be detached from the image supporter. Thus, the transfer supporter of the transfer supporter device is completely detached from the image supporter and hence the recording medium (sheet) jammed on the transfer supporter device can be removed with ease.

In this case, the transfer supporter device may be caused to be in the free state, because only the transfer supporter device can be easily drawn out from the image forming device when the transfer supporter device is in the free state.

Thus, it is unnecessary to carry out the following operations, that is: (i) operating a typically-provided lever to cause the transfer supporter device to be detached from the image supporter after the outer covering is opened; and (ii) drawing out the transfer supporter device together with the detaching/attaching mechanism to the outside, after the operation of the lever. On this account, fewer steps for drawing out the transfer supporter device, which is required for the jam treatment and maintenances, are required and hence the operations can be speedily performed.

Further, since the transfer supporter device can be drawn out from the image forming device without drawing out the release lever and detaching/attaching mechanism, the image forming device can be downsized and lightened, and the manufacturing and maintenance costs can be reduced.

To achieve the above-mentioned objective, the image forming device of the present invention, comprising: an image supporter on which an image is formed in accordance with image data; and a transfer supporter device including a transfer supporter which is detachable/attachable from/to the image supporter and transfers the image by contacting the image supporter, is characterized in that, support of the transfer supporter device with respect to a main body of the image forming device is released by performing an action of opening a part of an outer covering of the image forming device.

According to this arrangement, the action of opening the outer covering allows the support and positing of the transfer supporter device to be released, and hence the transfer supporter device is caused to be in the free state with respect to the image forming device.

Thus, the transfer supporter of the transfer supporter device is completely detached from the image supporter and hence the recording medium (sheet) jammed on the transfer supporter device can be removed with ease. Further, this arrangement allows only the transfer supporter device to be drawn out from the image forming device, without any additional operations.

As a result, it is unnecessary to carry out the following operations, that is: (i) operating a typically-provided lever to cause the transfer supporter device to be detached from the image supporter after the outer covering is opened; and (ii) drawing out the transfer supporter device together with the detaching/attaching mechanism to the outside, after the operation of the lever. On this account, fewer steps for drawing out the transfer supporter device, which is required for the jam treatment and maintenances, are required and hence the operations can be speedily performed.

Further, since the transfer supporter device can be drawn out from the image forming device without drawing out the release lever and detaching/attaching mechanism, the image forming device can be downsized and lightened, and the manufacturing and maintenance costs can be reduced.

The image forming device of the present invention, comprising: at least one image supporter on which an image is formed in accordance with image data; and a transfer supporter device including a transfer supporter which is detachable/attachable from/to said at least one image supporter and transfers the image by contacting the image supporter, is characterized in that, detachment/attachment of the transfer supporter device from/to a main body of the image forming device is caused by movement of the transfer supporter device in a direction orthogonal to an axis of a roller member which supports the transfer supporter to be rotatable.

The transfer supporter device is typically arranged in such a manner that, at least two frames (front frame and rear frame) are formed in the direction orthogonal to the axes of the roller members supporting the transfer supporter, and the roller members are supported by these frames.

According to this arrangement, for instance, the holding member for supporting and positioning the transfer supporter device is formed on the frames, so that the transfer supporter device can move as the holding member is caused to be placed along a guide member. Thus, the detachment/attachment of the transfer supporter device from/to the image forming device can be easily carried out.

As a result, the detachment/attachment of the transfer supporter device from/to the image forming device is carried out by causing the transfer supporter device to move in the direction orthogonal to the axes of the roller members supporting the transfer supporter, i.e. in the direction parallel to the frames of the image forming device, through an opening formed by causing the outer covering to move in the same direction. For this reason, it is possible to easily detach/attach the transfer supporter device, along the frames.

Moreover, for detaching/attaching the transfer supporter device, it is unnecessary to newly provide an opening through the frames, and hence the decrease of the strength of the frames does not occur. Since the enhancement of the strength of the frames by, for instance, increasing the thickness of the frames is unnecessary, it is possible to reduce the weight of the image forming device.

To achieve the foregoing objective, the image forming device of the present invention, comprising: a plurality of image supporters on which images are formed in accordance with image data; and a transfer supporter device including a transfer supporter which is detachable/attachable from/to said at least one image supporter and transfers the image when a voltage is supplied from a plurality of transfer members, said plurality of image supporters being provided in a direction orthogonal to the axis of the roller member, the image forming device having: an image forming mode (a) with which all of said plurality of image supporters are caused to be in touch with the transfer supporter; and an image forming mode (b) with which at least one of said plurality of image supporters is caused to be in touch with the transfer supporter, is characterized in that, when the image forming mode (b) is selected, at least one of said plurality of transfer members, which corresponds to at least one of said plurality of image supporters not being in contact with the transfer supporter and is not provided at a proximity of an end of the transfer supporter device, is not in contact with the transfer supporter.

Generally, when the image forming mode (monochrome mode) with which a particular image supporter is used is adopted, the contact between the transfer members corresponding to the image supporters not being used for image formation and the transfer supporter deteriorates, and especially the contact between the transfer member not provided at the end portion and the transfer supporter significantly deteriorates. For this reason, the transfer member, which corresponds to the unused image supporter and is not provided at the end portion, cannot be rotated by the frictional force between the transfer member and transfer supporter. Thus, the transfer member which cannot be rotated is irregularly worn, thereby causing troubles such that the lifespan of the transfer member is shortened and the transfer is irregularly done.

In this connection, according to the above-mentioned arrangement, such transfer supporters are caused not to be in contact with the transfer supporter so that the above-mentioned problems can be prevented and high-quality image formation can be carried out for a long period of time.

For a fuller understanding of the nature and advantages of the invention, reference should be made to the ensuing detailed description taken in conjunction with the accompanying drawings.

BRIEF DESCRIPTION OF THE DRAWINGS

In the Drawings:

FIG. 6(*b*) illustrates the placement of the photosensitive drum and transfer belt unit, when a multicolor image forming mode is selected;

FIG. 6(*c*) illustrates the placement of the photosensitive drum and transfer belt unit, when a monochrome image forming mode is selected;

FIG. 17(*b*) is a perspective view from above, illustrating the housing of two supporting units connected with each other;

FIG. 18(*b*) is a perspective view from above, illustrating the housing with the rollers;

FIG. 19(*b*) is an enlarged view, illustrating an area indicated by a circle B in FIG. 19(*a*);

FIG. 19(*c*) is an enlarged view, illustrating an area indicated by a circle C in FIG. 19(*a*);

FIG. 22(*b*) is a cross section of a substantial part of two transfer rollers in FIG. 18(*a*), for comparing the height of these transfer rollers with each other;

DESCRIPTION OF THE EMBODIMENTS

The following will describe an embodiment of the present invention with reference to FIGS. 1-24.

Figure 1:
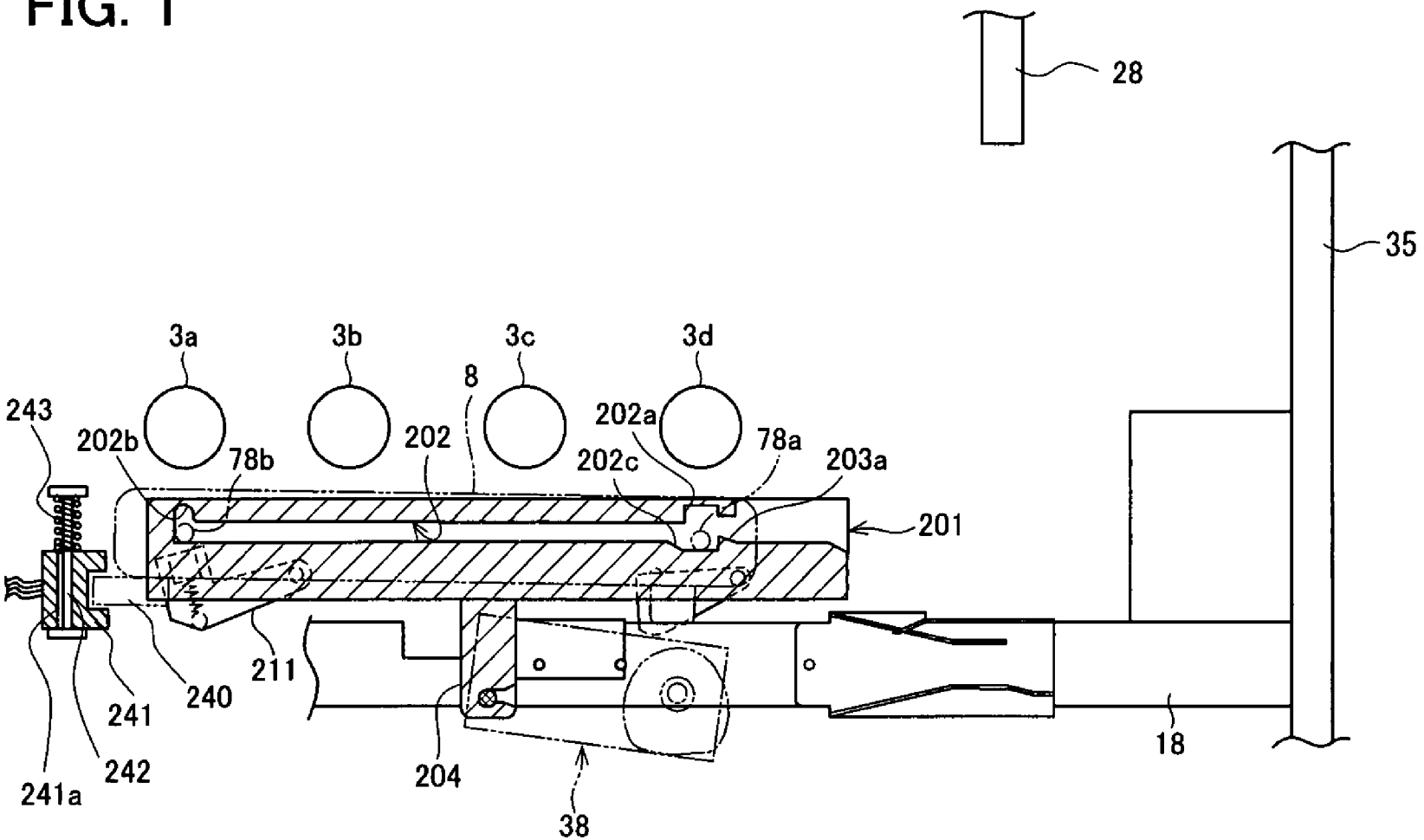
FIG. 1 illustrates a substantial part of an image forming device in which a transfer belt unit is in a free state, when a detaching/attaching mechanism of an embodiment of the present invention is adopted to the transfer belt unit.

FIG. 1 illustrates a substantial part of a detaching/attaching mechanism of an image forming device of the present embodiment, in which a transfer belt unit (transfer supporter device, contacting member) 8 is detached from or attached to photosensitive drums (image supporters, supporting members) 3*a*-3*d*. As the figure shows, the detaching/attaching mechanism is arranged in such a manner that the transfer belt unit 8 is either in an image forming position or in a free position in which the transfer belt unit 8 is in a free state so as not to contact any one of the photosensitive drums 3*a*-3*d*. The detaching/attaching mechanism is further provided with rail members (holding members, aligning members) 201, and slide sections (pushing members) 18 interlocked with a side cover (a part of an outer covering) 35 of the image forming device.

Figure 15:
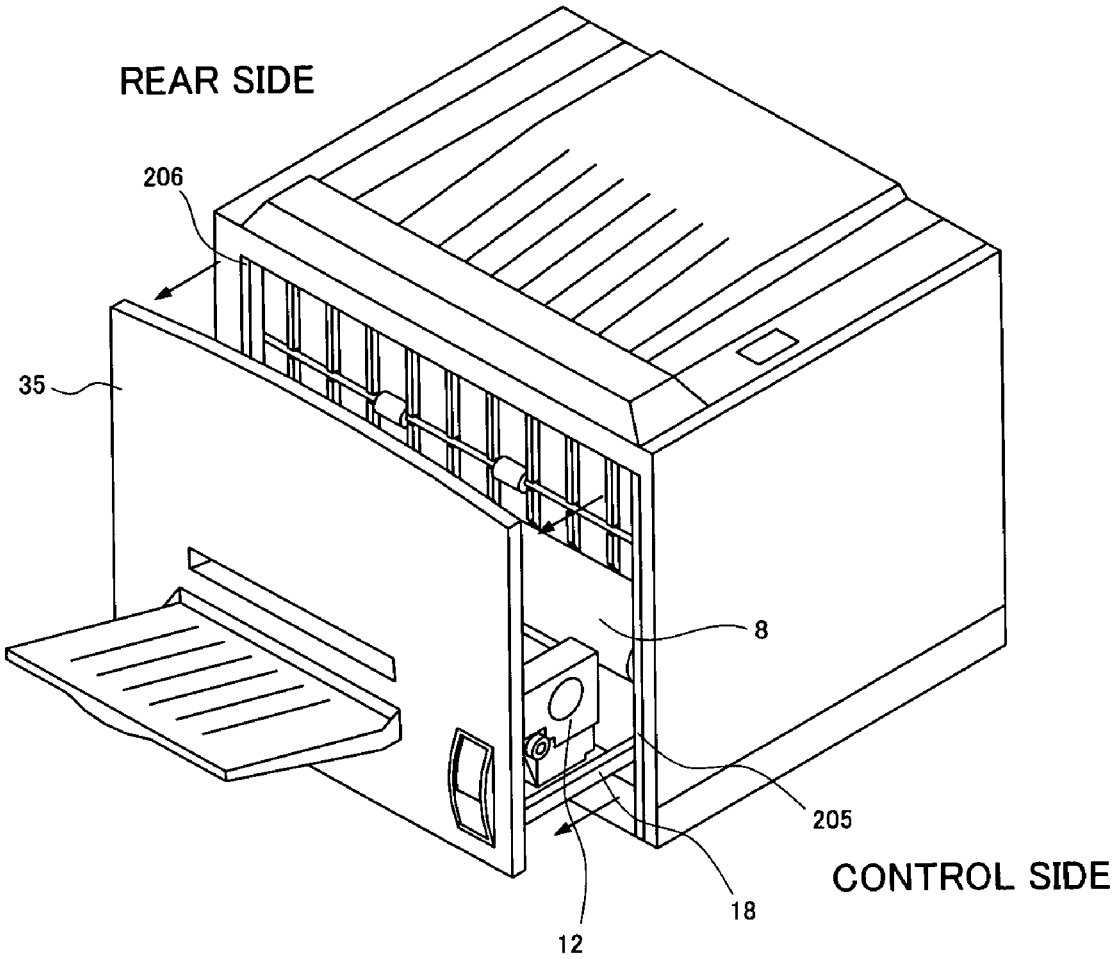
FIG. 15 is a perspective view, illustrating the image forming device.

As FIG. 15 shows, the outer covering of the image forming device includes a front frame 205 on the operating side, a rear frame 206 on the rear side, and the side cover 35 which is openable. The front and rear frames (frame members, frames) are main frame members of the image forming device. Note that, in the present embodiment, the side cover 35 constitutes a part of the side face of the image forming device. Thus, when the side cover 35 is closed, the side cover 35 and an upper side cover 28 (cf. FIGS. 1 and 2) constitute the side face of the outer covering of the image forming device.

The front frame 205 and rear frame 206 are orthogonal to roller members (e.g. a drive roller 71 and tension roller 73 which will be described later) for supporting a below-mentioned transfer belt (transfer supporter, contacting member) 7 of the transfer belt unit 8. Further, the front frame 205 and rear frame 206 are provided on the respective side faces which are in parallel to the direction of transporting sheets. With reference to these front and rear frames 205 and 206, functional units for performing, for instance, an image forming process are aligned and provided.

Figure 23:
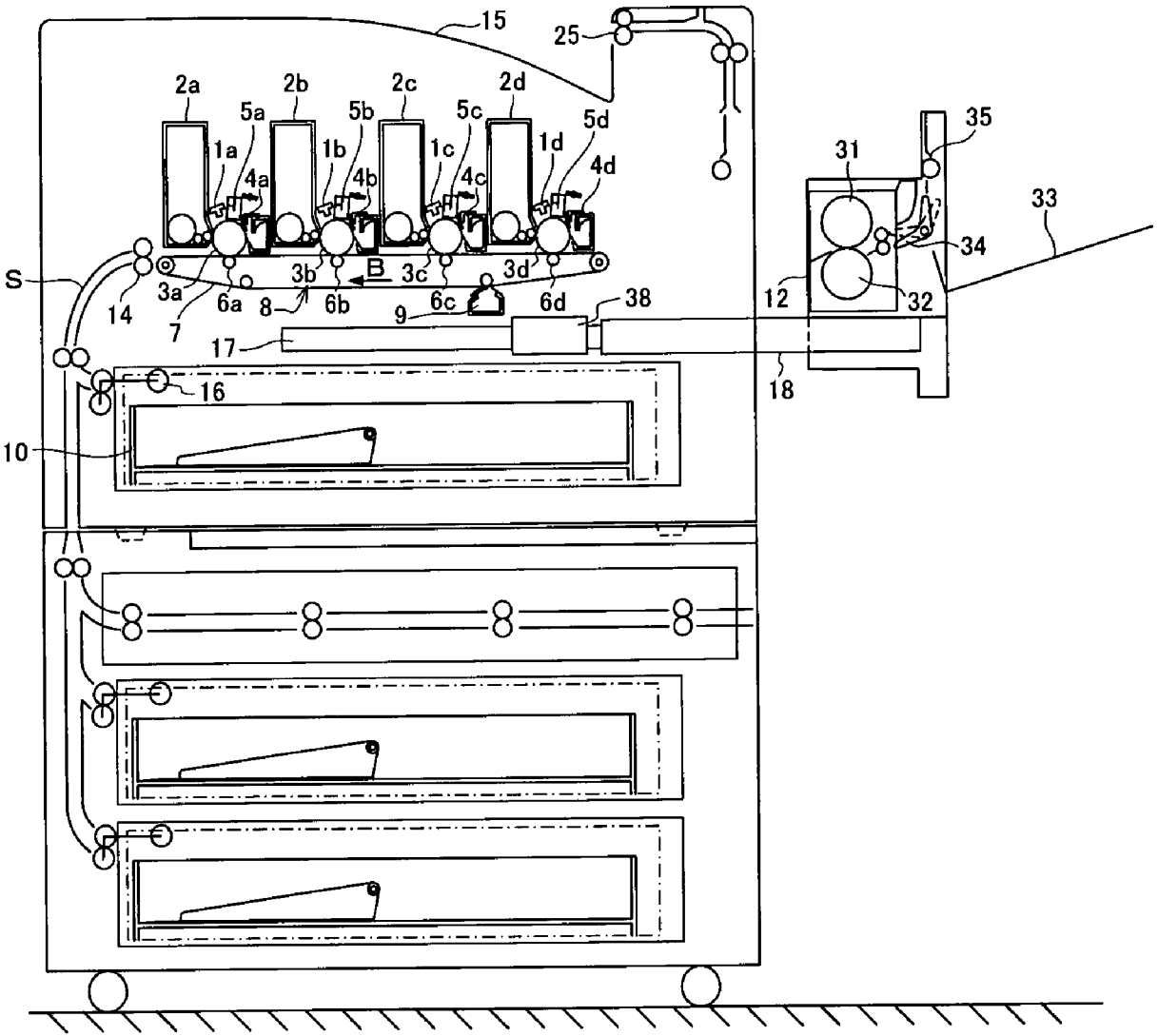
FIG. 23 illustrates a photocopier including the image forming device and a sheet feeding device.

Below the transfer belt unit 8, as FIG. 23 illustrates, a slide plate including a fixing section 17 and the slide section 18 is provided. This slide plate is interlocked with the side cover 35, thereby being drawn out in combination with the side cover 35. In the present embodiment, two slide plates which are Accuride® are provided on the side of the front frame 205 and the side of the rear frame 206, respectively.

In the image forming device, the transfer belt unit 8 is supported by rail members 201 (see FIG. 1) which are fixed to the inner side of the front frame 205 and the inner side of the rear frame 206 (see FIG. 15), respectively.

Figure 3:
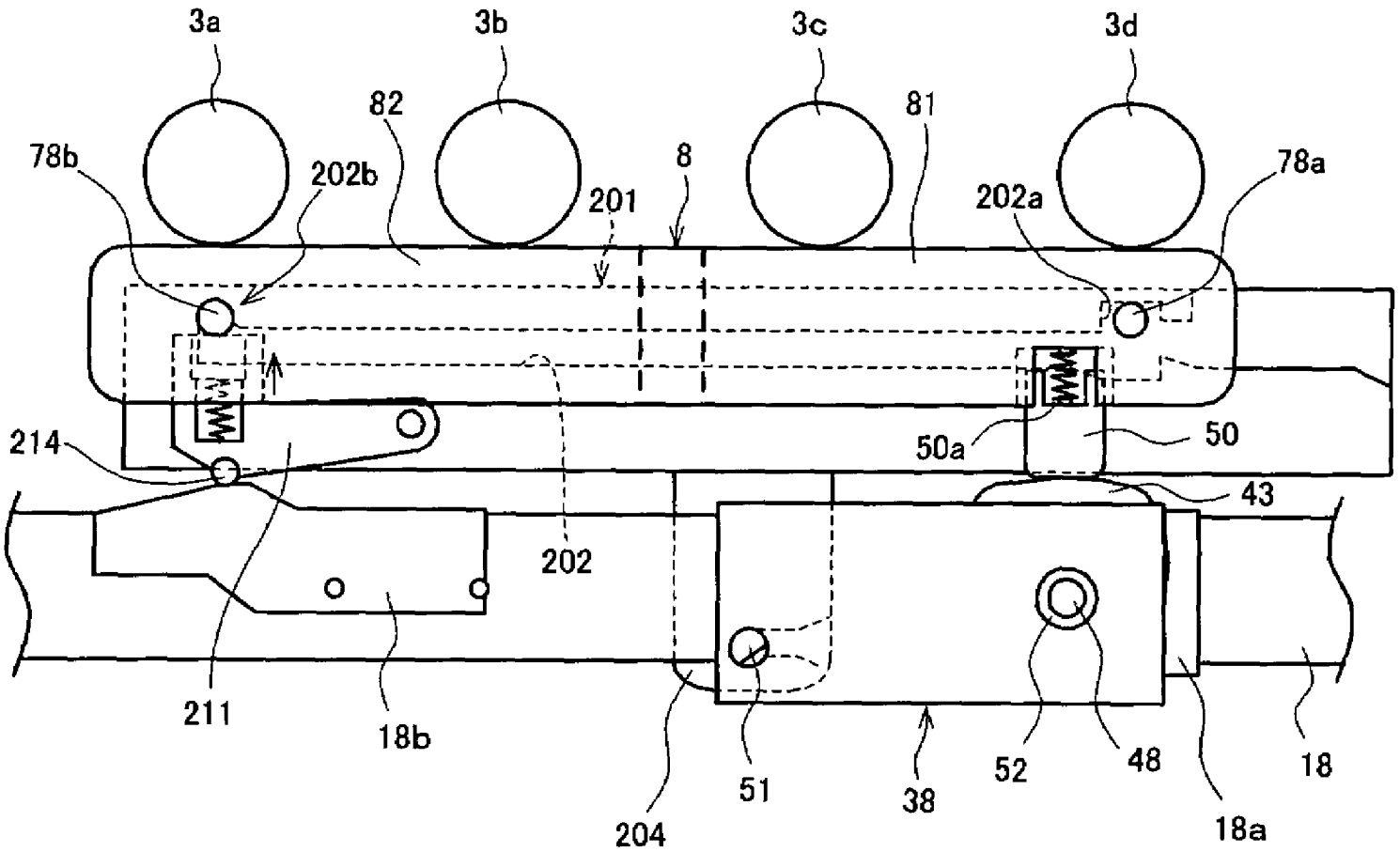
FIG. 3 illustrates a rail member and slide section.

Also, as FIG. 3 illustrates, the transfer belt unit 8 includes supporting axes 78*a* and 78*b* and a holding member 50.

Figure 2:
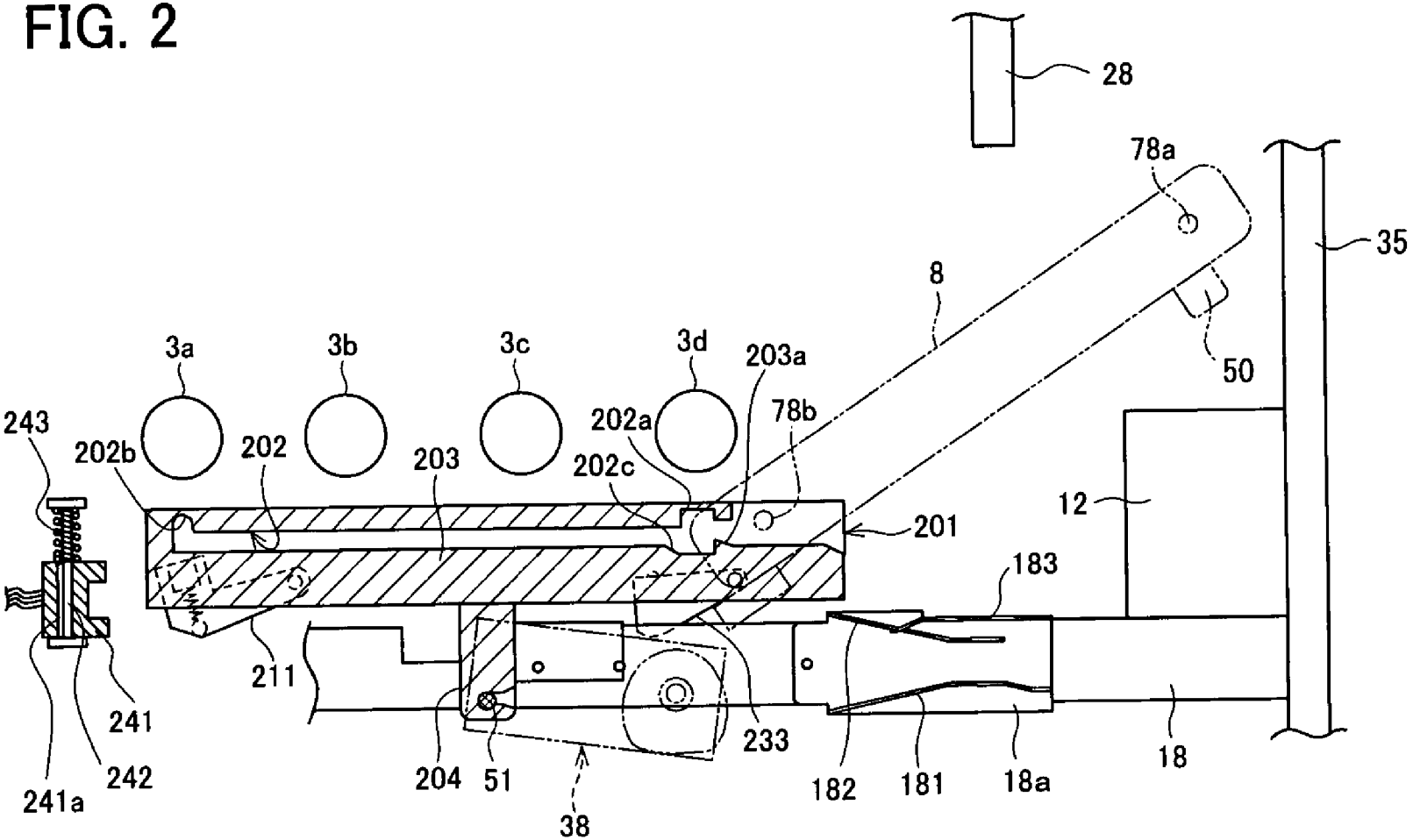
FIG. 2 illustrates how the transfer belt unit is put and taken off.

Each of the rail members 201 (holding members, aligning members) includes, as FIG. 2 shows, a unit lift arm (swing-move member) 211 and a stopper member lifting arm (swing-move member) 233, and is further provided with a rail groove 202 on a surface 203 facing the transfer belt unit 8. The rail groove 202 is provided for guiding the supporting axes 78*a* and 78*b* of the transfer belt unit 8, in order to attach or detach the transfer belt unit 8 to/from the image forming device.

The rail groove 202 has notches 202*a* and 202*c* facing each other in the vertical direction of the image forming device and a positioning hole 202*b*.

The positioning hole (positioning means) 202*b* determines the position of the supporting shaft 78*b*, and supports the transfer belt unit 8 to be rotatable. The notch (positioning means) 202*a* determines the position of the notch 202*a* provided on the rotatable side of the transfer belt 8. That is to say, the supporting shaft 78*a* is pushed onto the notch 202*a* so as to be placed at the image forming position.

Facing the notch 202*a*, the notch (position regulating means) 202*c* and a convex section (position regulating means) 203*a* are provided. The notch 202*c* and convex section 203*a* prevents the deviation of the supporting shaft 78*a*, when the transfer belt unit 8 is in the free state. Note that, the free state indicates such a state that the transfer belt unit 8 is released from the pushing force so that the supporting axes 78*a* and 78*b* of the transfer belt unit 8 are in touch with the lower surface of the rail groove 202.

The convex section 203*a* is provided so as to be closer to a slot from which the transfer belt unit 8 is inserted into the image device, i.e. closer to the side cover 35, compared to the notch 202*a*. The notch 202*a* and convex section 203*a* are provided to prevent the transfer belt unit 8 not to incorrectly move towards the opening, when the transfer belt unit 8 is in the free state. Further, the notch 202*a* and convex section 203*a* enable the user to "sense" that the transfer belt 7 is securely inserted, when the user inserts the transfer belt unit 8 into the opening.

Note that, although the notch 202*a* and convex section 203*a* are provided in the present embodiment, the present invention is not limited to this arrangement so that the above-described function can be carried out by either one of these members.

The unit lift arm 211 and stopper member lifting arm 233 are supported by the rail member 201 so as to be rotatable.

Figure 5:
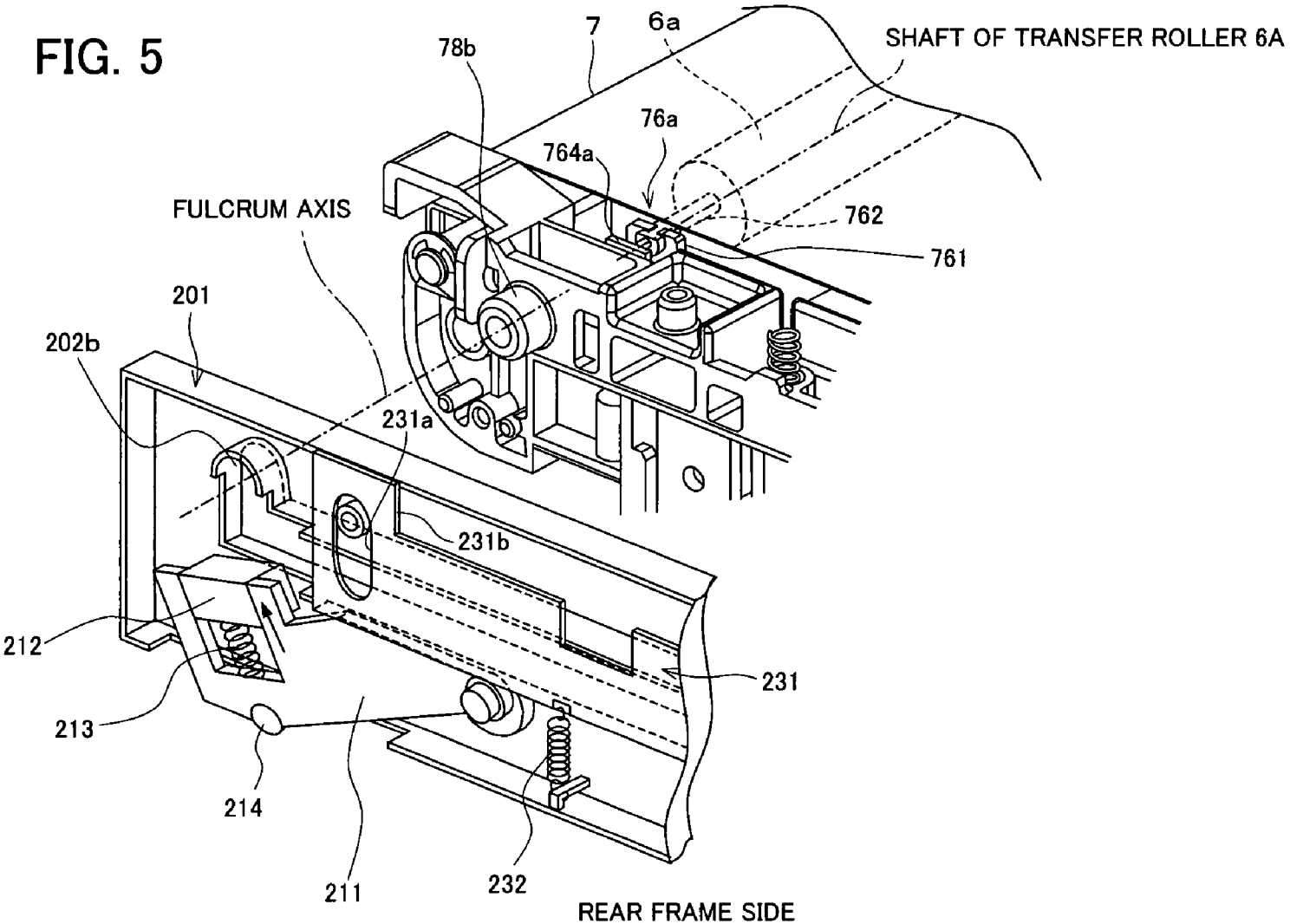
FIG. 5 is a perspective view, illustrating the transfer belt unit corresponding to a unit lift arm.

As FIG. 5 shows, the unit lift arm 211 includes a lift block 212, compression coil spring (elastic member) 213, and lift skid 214.

The lift block 212 is supported to be able to slide and pushed in the direction indicated by an arrow in the figure (i.e. in the direction towards the photosensitive drums 3*a*-3*d*) by the compression coil spring 213.

The lift skid 214 is attached to the unit lift arm so as to be rotatable.

Meanwhile, below the unit lift arm 211, the slide section 18 is provided. The slide section 18 is, as FIG. 3 shows, provided with slide cams 18*a* and 18*b*.

As illustrated in FIG. 3, the lift skid 214 contacts the top surface of the slide cam 18*b*. As illustrated in FIG. 2, the slide cam 18*a* contacts the stopper member lifting arm 233 at a flat section 183 which is the top surface of the slide cam 18*a*, and also contacts the detaching/attaching control section 38 at a slope section 181 below the flat section 183.

The lift skid 214, stopper member lifting arm 233, and detaching/attaching control section 38 are respectively arranged to rotate in synchronization with the action of opening or closing the side cover 35.

Note that, on the upper side of the slide cam 18*a*, a slope section 182 may be provided so as to correspond to the slope section 181 of the slide cam 18*a* of the other side. Symmetrically providing the slope sections, identically-formed components can be adopted to the slide cams 18*a* of the both sides. Thus, the components can share a single mold so that the manufacturing cost can be reduced thanks to volume efficiency.

Now, the insertion of the transfer belt unit 8 into the image forming device is discussed as below.

As FIG. 2 illustrates, after opening (drawing out) the side cover 35, the transfer belt unit 8 is inserted from a widely-opened space. On this occasion, first, the transfer belt unit 8 is kept at a slant with respect to the image forming device, and the supporting shaft 78*b* is fitted in the rail groove 202 of the rail members 201. Then the supporting shaft 78*b* is caused to slide along the rail groove 202 so that the transfer belt unit 8 is inserted into the image forming device.

When carrying out the insertion, a fixing device 12 to be drawn out with the side cover 35 may be removed. This makes it possible to further enlarge the above-mentioned area for the insertion (i.e. an opening from which the insertion into the image forming device is carried out).

As the insertion of the transfer belt unit 8 proceeds, the transfer belt unit 8 is caused to be in the horizontal position.

When the supporting shaft 78*a* passes the convex section 203*a* and fitted into the notch 202*a*, the insertion of the transfer belt unit 8 into the image forming device is completed.

Note that, the user can confirm the completion of the insertion of the transfer belt unit 8 by sensing that the supporting shaft 78*a* drops from the convex section 203*a* to the notch 202*a*.

At this point, the transfer belt unit 8 is in the free state (in a state that the support of the transfer belt unit 8 is released) and so that the distance between the photosensitive drums 3 and transfer belt 7 is sufficiently kept.

Next, the positioning of the inserted transfer belt unit 8 is determined by the rail member 201, i.e. the support of the transfer belt unit 8 is carried out. The positioning is carried out by closing the side cover 35.

That is to say, after the insertion of the transfer belt unit 8, the side cover 35 is closed so that the slide section 18 is guided into the fixing section 17, thereby sliding inside the image forming device.

On this occasion, the slide cam 18*b* contacts (pushes) the unit lift arm 211 so that the unit lift arm 211 rotates upward. With this action, the lift block 212 pushes up the supporting shaft 78*b*, and thus the supporting shaft 78*b* is guided into the positioning hole 202*b*. Also, due to the thrust from the compression coil spring 213, the supporting shaft 78*b* is kept in the positioning hole 202*b*. In this manner, the supporting shaft 78*b* is positioned in the positioning hole 202*b* when the side cover 35 is closed.

Note that, the supporting shaft 78*b* positioned and kept in the positioning hole 202*b* functions as a rotation axis of the transfer belt unit 8. Thus, the lift block 212 is preferably made of, for instance, POM which is finely self-lubricative, in order not to obstruct the rotation of the supporting shaft 78*b*.

In the meantime, by closing the side cover 35, the supporting shaft 78*a* is also pushed up by the detaching/attaching control section 38 almost simultaneously with the supporting shaft 78*b*, thereby being kept (positioned) to be in touch with the notch 202*a*.

In other words, this operation is carried out in such a manner that, the side cover 35 is closed so that the whole of the detaching/attaching control section 28 is caused to rotate upward, and as a result the cam section 43 is caused to be in touch with and push up the holding member 50.

On this occasion, because of the thrust from an elastic member 50*a* provided between the holding member 50 and housing 70, the supporting shaft 78*a* of the transfer belt unit 8 is pushed on and kept at the notch 202*a*.

Figure 13:
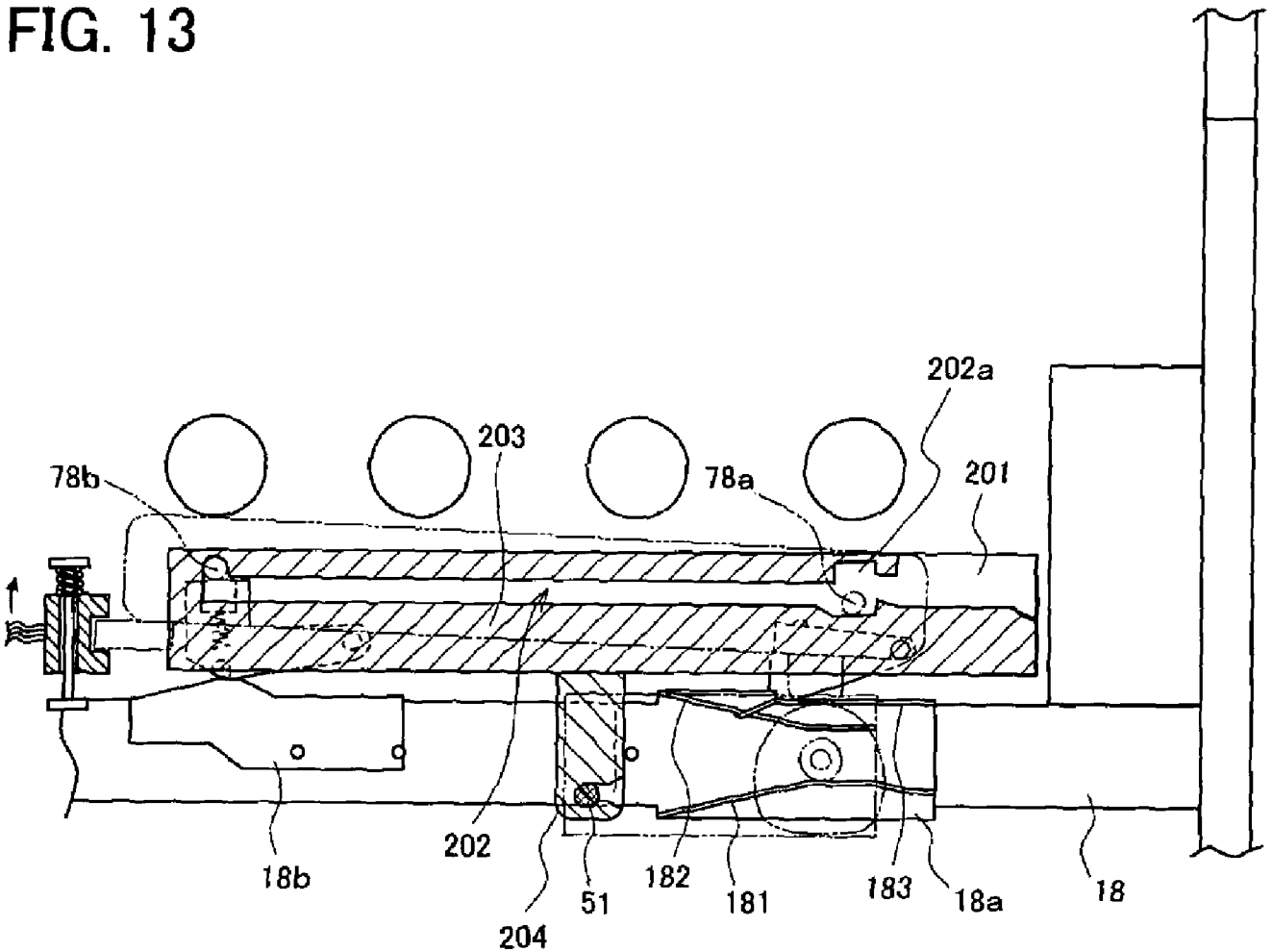
FIG. 13 illustrates a condition that an end of a supporting shaft of the transfer belt unit is supported by the rail member, when the monochrome mode is selected.
Figure 14:
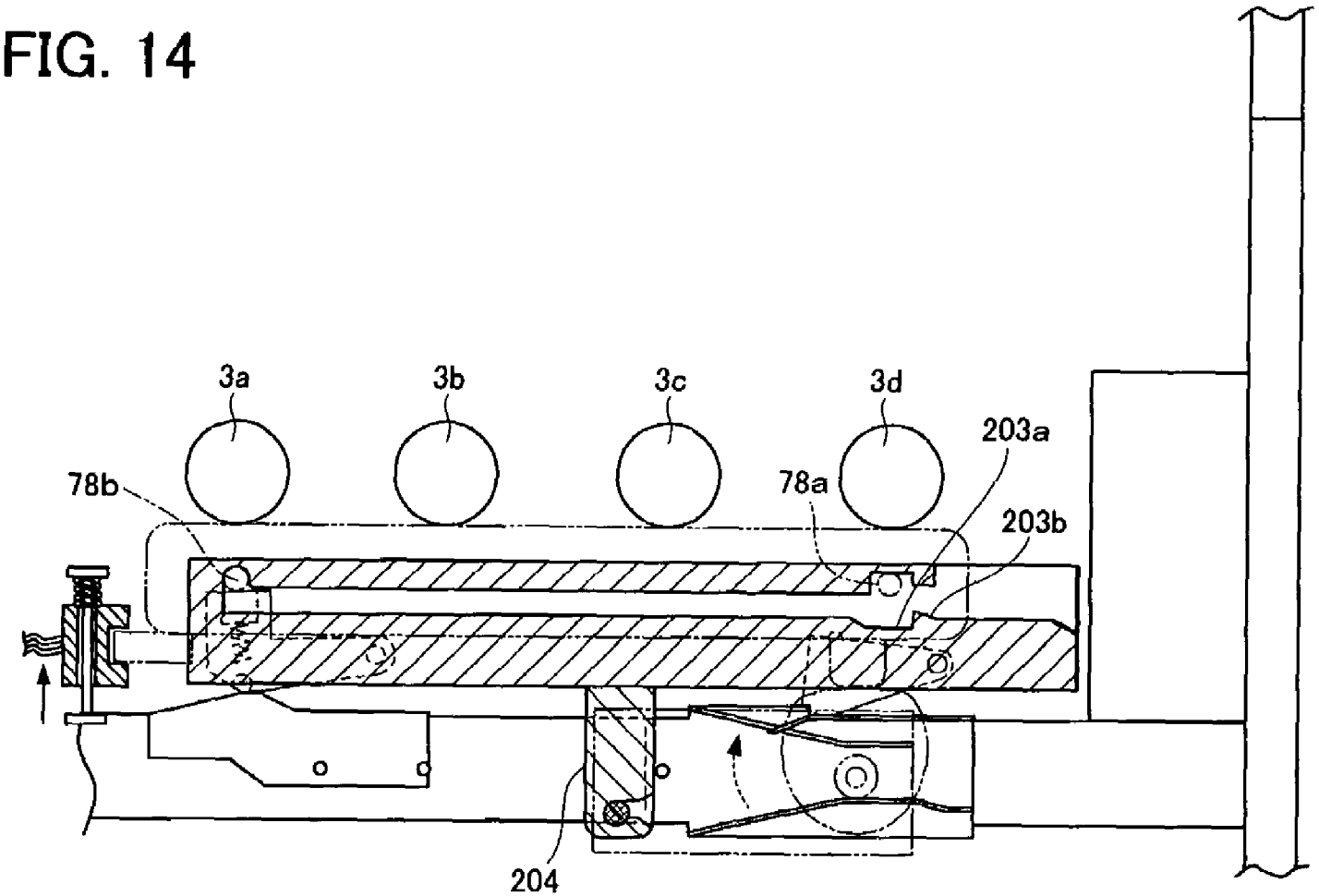
FIG. 14 illustrates a condition that an end of the supporting shaft of the transfer belt unit is supported by the rail member, when the multicolor mode is selected.

Here, if, for instance, the multicolor mode is set as a default image forming mode, the cam section 43 is in the state illustrated in FIG. 14. If the monochrome mode is set as a default image forming mode, the cam section 43 is in the state illustrated in FIG. 13.

As shown in FIG. 3, the rotation and movement of the whole detaching/attaching control section 38 is carried out by the following arrangement: Rotating bosses 51 provided in respective below-mentioned frame sections 49 (see FIG. 9) of the detaching/attaching control section 38 are inserted in respective holes of detaching/attaching means supporting section 204 extending downward from the rail members 201 so that the rotating bosses 51 are rotatable, and the rotating bosses 51 are interlocked with the respective slope sections 181 on the lower parts of the slide cams 18*a*, via sleeves 52 provided along the circumferences of rotating axes 48 of the detaching/attaching control section 38.

Note that, the rotating bosses 51 of the detaching/attaching control section 38 and the detaching/attaching means supporting sections 204 extending downward from the rail members 201 have respective notches. With this arrangement, it is possible to easily detach or attach the detaching/attaching control section 38, from the side of the side cover 35, and hence it is possible to reduce the manufacturing time and costs.

The release of the support of the transfer belt unit 8 is carried out by opening (drawing out) the side cover 35, and thus this operation is opposite to the above. That is to say, the release of the support is carried out in such a manner that the supporting shafts 78*b* and 78*a* of the transfer unit 8 drop to the lower surfaces of the rail grooves 203 of the respective rail members 201.

With this arrangement, it is possible to release the support of the transfer belt unit 8, without any one of the following operations, that is: (i) operating a lever to release the positioning of the transfer belt unit after the outer covering is opened; (ii) removing the transfer belt unit from a drawn-out unit after members such as the drawn-out unit supporting the transfer belt unit are drawn out from the image forming device; and (iii) adopting a mechanical section carrying out the operation (ii).

That is to say, the support of the transfer belt unit 8 is released only by opening the side cover 35, so that the transfer belt unit 8 is caused to be in the free state that a sufficient distance between the transfer belt unit 8 and photosensitive drums 3 is provided. With this arrangement, it is possible to draw out the image device or remove a sheet remaining on the transfer belt 7 because of paper jam, without using any tools for releasing the transfer belt unit 8.

Thus, the image forming device can be downsized and lightened, so that good maintainability and cost reduction can be realized.

Figure 11:
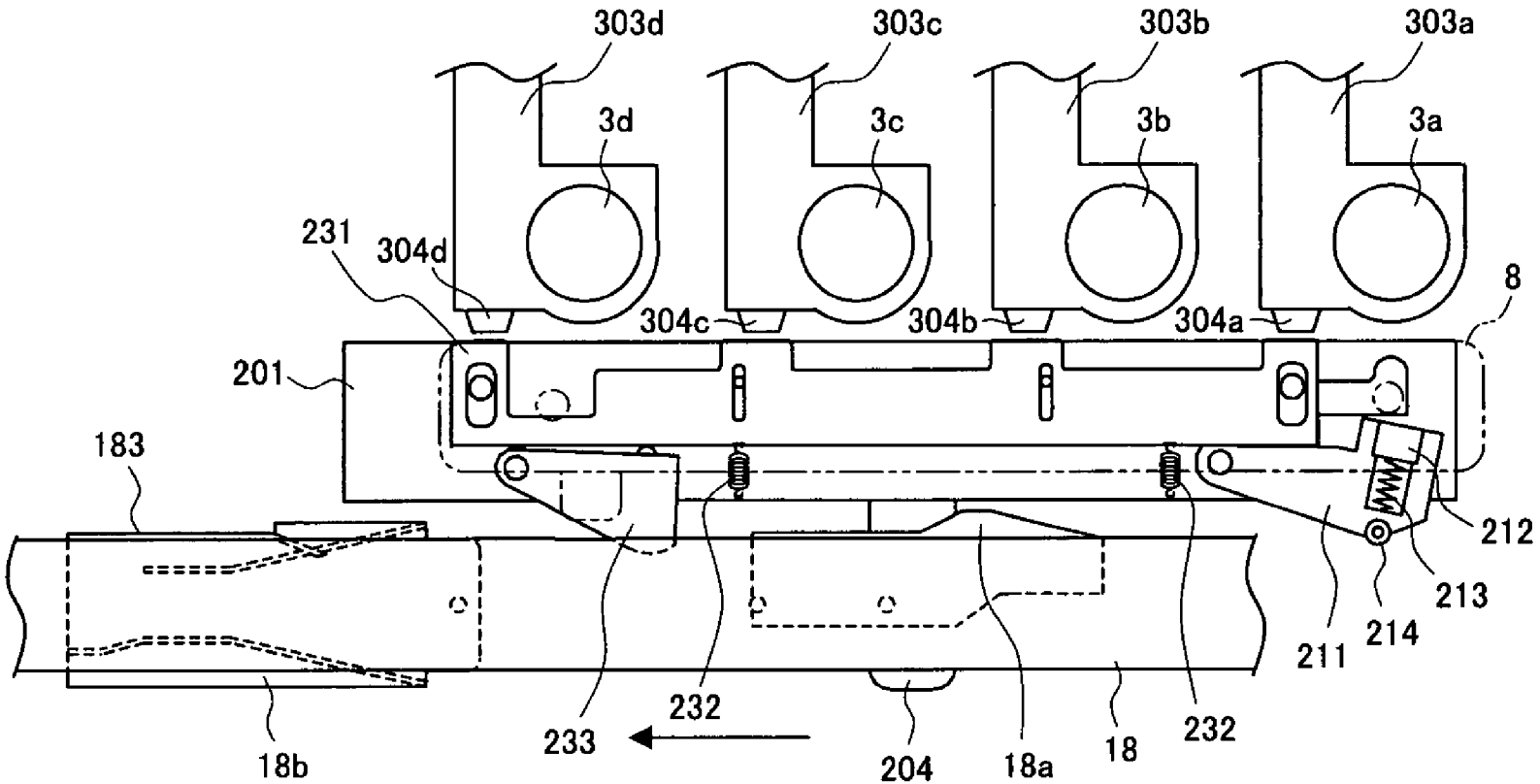
FIG. 11 illustrates a condition that a convex section of a process unit is separated from a stopper member.
Figure 12:
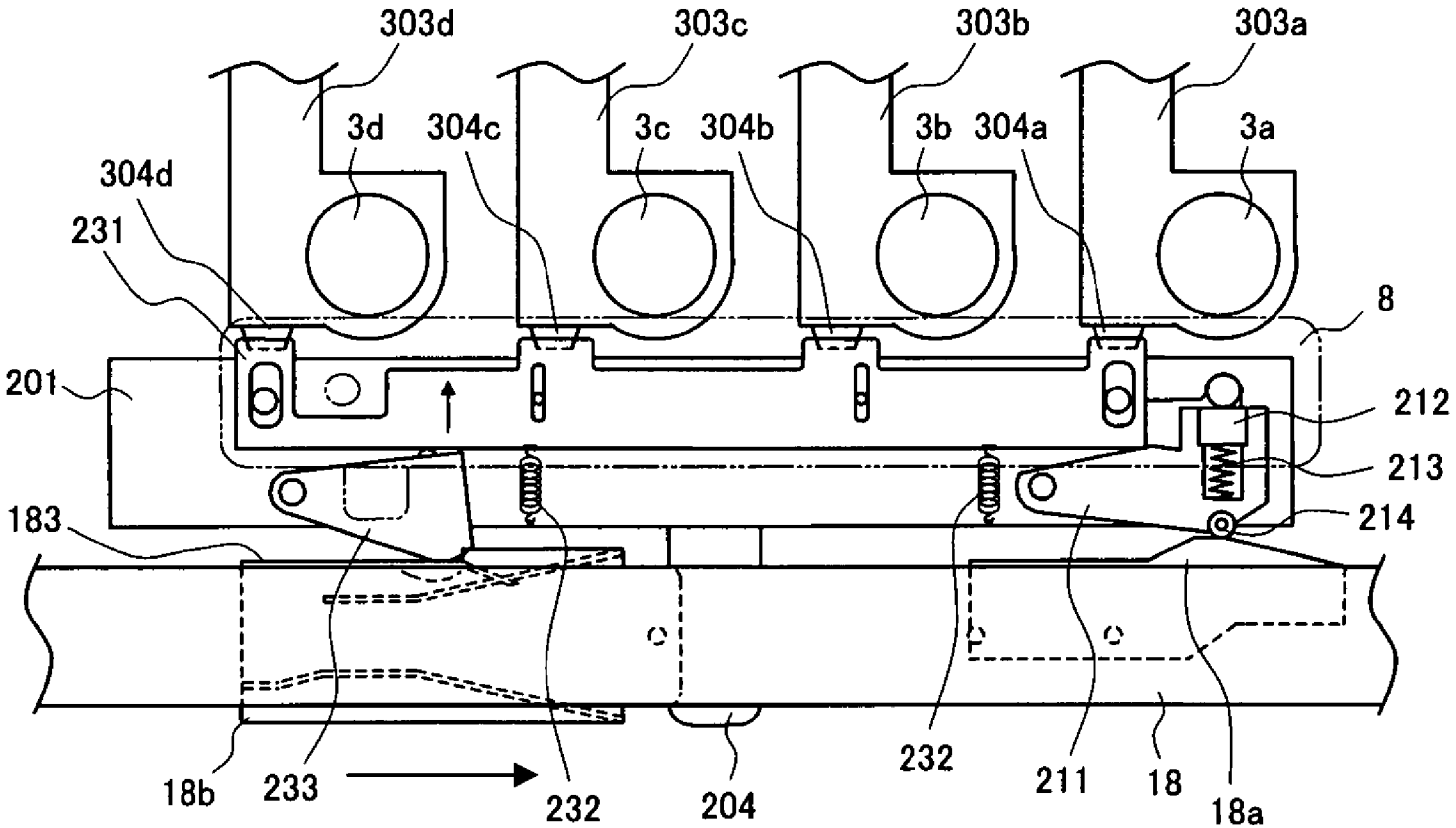
FIG. 12 illustrates a condition that the convex section of the process unit is engaged with the stopper member.

The following will discuss a stopper member (blocking member) for coupling the photosensitive drums 3 with the transfer belt unit 8, with reference to FIGS. 5, 11, and 12.

As FIG. 5 suggests, the image forming device is further provided with a stopper member 231. The stopper member 231 is made of a steel thin plate, provided between the inner surface of the front frame 205 (see FIG. 15) and the rail member 201, and can slide in the vertical direction thanks to a plurality of guiding members of the rail member 201. Further, the stopper member 231 is always pushed downward by elastic members 232.

As described above, the side cover 35 is closed so that the slide cam 18*a* is coupled with the unit lift arm 211 and the slide cam 18*b* is coupled with the stopper lifting arm 233 (cf. FIG. 11). Thus, the unit lift arm 211 and stopper member lifting arm 233 rotate and slide in the direction to the top surface, the stopper member 231 is pushed up, and thus parts of the stopper member 231 is caused to protrude from the rail member 201.

Thus, as FIG. 12 shows, the protruding parts of the stopper member 231 are caused to be coupled with respective convex sections 304 (304*a*, 304*b*, 304*c*, and 304*d*)

which are for preventing mis-drawing and provided on respective process units 303 (303*a*, 303*b*, 303*c*, and 303*d*) including the photosensitive drums 3, for instance, the protruding parts are caused to be engaged with the convex sections, so that the drawing-out of the photosensitive drums 3 from the image forming device can be prevented. That is to say, this arrangement makes it possible to prevent the process units 303 including the photosensitive drums 3 from being drawn out.

With this arrangement, when the side cover 35 is not opened, i.e. the support of the transfer belt unit 8 is not released so that the distance between the photosensitive drums 3 and transfer belt 7 is not sufficiently provided, one cannot draw out the process units 303.

As a result, it is possible to prevent the process units 303 from being drawn out when the transfer belt 7 is in touch with the photosensitive drums 3, and thus it is possible to avoid the photosensitive drums 3 and transfer belt 7 to be scratched.

Meanwhile, by opening the side cover 35, as FIG. 11 illustrates, the coupling of the slide cam 18*a* with the unit lift arm 211 and the coupling of the slide arm 18*b* with stopper member lifting arm 233 are released. Thus, the unit lift arm 211 and stopper member lifting arm 233 rotate and move toward the lower surface, the pushing-up of the stopper member 231 is released, and the end (top end) of the stopper member 231 is caused to be lower than the top end of the rail member 201 thanks to the elastic members 232 which push the stopper member 231 downward.

On this account, the convex sections 304 for preventing the mis-drawing of the process units 303 including the photosensitive drums 3 are released and this allows the process units 303 including the photosensitive drums 3 to be drawn out.

As described above, when the transfer belt 7 is in touch with the photosensitive drums 3, it is not possible to draw out the process units including the photosensitive drums 3, even by mistake. With this arrangement, it is possible to avoid the photosensitive drums 3 and transfer belt 7 to be scratched.

Note that, in the present invention, the transfer supporter device which is detachable from the image forming device and includes the detaching/attaching mechanism is not limited to the transfer belt unit 8. One can adopt a photosensitive belt or sheet transfer belt for transporting documents and sheets, as the transfer supporter device.

As described above, the detaching/attaching mechanism, in which the transfer belt unit (contacting member) 8 is supported so as to be attachable to or detachable from the photosensitive drums (supporting members) 3, includes: the rail member (holding member) 201 supporting the transfer belt unit 8; and the slide section 18 and detaching/attaching control section (pushing member) 38 both pushing the transfer belt unit 8 in the direction toward the photosensitive drums 3 via the rail member 201 in order to cause the transfer belt unit 8 to be in touch with the photosensitive drums 3. The rail member 201 is further provided with the notch 202*a* and positioning hole (positioning means) 202*b* for positioning the transfer belt unit 8 when the transfer belt unit 8 is in touch with the photosensitive drums 3. Causing the slide section 18 and detaching/attaching control section 38 to move in one direction, the support of the transfer belt unit 8 by the notch 202*a* and positioning hole 202*b* is released, and hence the transfer belt unit 8 can be distanced from the photosensitive drums 3.

With this arrangement, only by causing the slide section 18 and detaching/attaching control section 38 to move in one direction, one can easily make the transfer belt unit 8 be in the free state, and thus the transfer belt unit 8 can be easily replaced.

Moreover, the detaching/attaching mechanism, in which the transfer belt unit (contacting member) 8 is supported so as to be attachable to or detachable from the photosensitive drums (supporting members) 3, includes: the rail member (holding member) 201 for supporting the transfer belt unit 8; and the slide section 18 and detaching/attaching control section (pushing member) 38 both pushing the transfer belt 8 in the direction toward the photosensitive drums 3, via the rail member 201. The rail member 201 includes: the positioning means (notch 202*a* and positioning hole 202*b*) for positioning the contacting member when the transfer belt unit 8 is in touch with the photosensitive drums 3; and the notch 202*c* and convex section 203*a* (position regulating means) for preventing the deviation of the transfer belt unit 8 with respect to the rail member 201 when the transfer belt unit 8 is distanced from the photosensitive drums 3. When the transfer belt unit 8 is in touch with the photosensitive drums 3, the transfer belt unit pushed by the slide section 18 and detaching/attaching control section 38 is supported by the notch 202*a* and positioning hole 202*b*, while, when the transfer belt unit 8 is distanced from the photosensitive drums 3, the transfer belt unit 8 is provided on the rail member 201 so as to be supported.

With this arrangement, since the transfer belt unit 8 is merely provided on the rail member 201 (i.e. the support from the rail member 201 is released) when the transfer belt unit 8 is distanced from the photosensitive drums 3, the transfer belt unit 8 is in the free state. Thus, the transfer belt unit 8 can be easily replaced.

Furthermore, even when the transfer belt unit is in the free state and not positioned by the notch 202*c* and convex section 203*a*, unnecessary deviation of the transfer belt unit 8 is prevented.

Moreover, for instance, since either one of the notch 202*a* and positioning hole 202*b* faces the notch 202*c* and convex section 203*a*, it is possible to smoothly cause the transfer belt unit 8 in the free state to be positioned.

The detaching/attaching mechanism is preferably arranged such that the rail member (holding member) 201 is provided with the rail groove (guiding groove) which allows the transfer belt unit (contacting member) 8 to be detachable/attachable.

This arrangement allows the transfer belt unit 8 to be easily replaced.

That is to say, the image forming device provided with the detaching/attaching mechanism includes: the photosensitive drums (image supporters) 3 on which images are formed in accordance with image data; and the transfer belt unit (transfer supporter device) 8 which is attachable to and detachable from the photosensitive drums 3 and includes the transfer belt (transfer supporter) 7 for transferring the images by contacting the photosensitive drums.

Then the transfer belt unit 8 is caused to be distanced from the photosensitive drum 3, as the side cover 35 (a part of the outer covering) of the image forming device is opened. Alternatively, the support of the transfer belt unit 8 with respect to the main body of the image forming device is released, as the side cover 35 (a part of the outer covering) of the image forming device is opened.

Thus, the transfer belt 7 of the transfer belt unit 8 is completely detached from the photosensitive drums 3, and this makes it possible to easily remove a sheet jammed on the transfer belt unit 8.

On this condition, the transfer belt unit 8 may be in the free state, and in this state, it is possible to easily draw only the transfer belt unit 8 out from the image forming device.

In this arrangement, it is not necessary to carry out the following operations: operating a release lever for causing the transfer belt unit 8 to be detached from the photosensitive drums 3, after opening the outer covering; and drawing out the transfer belt unit 8 together with a detaching mechanism, after the operation of the release lever. With this arrangement, fewer steps are required for drawing out the transfer belt unit 8 in order to perform the jam treatment and maintenance, and thus the operation can be speedily carried out.

Further, since the transfer belt unit 8 can be drawn out from the image forming device without drawing out the release lever and detaching mechanism, the image forming device can be downsized and lightened, and the manufacturing and maintenance costs can be reduced.

The side cover 35, which is a part of the outer covering of the image forming device, is in parallel to the respective axes of the drive roller 73 and a tension roller 71 (roller members) supporting the transfer belt 7 of the transfer belt unit 8 to be rotatable, and can be opened in the direction orthogonal to these axes.

That is to say, the side cover 35 is a part of the outer covering, which is in parallel to one of six sides of the image forming device, except two sides on which the frames 205 and 206 are provided. Thus, since it is unnecessary to provide an opening through at least either one of the frames 205 and 206 in order to attach and detach the transfer belt unit 8, the strengths of the frames 205 and 206 are not decreased. Given that the strengthening of the frames 205 and 206 by, for instance, increasing the thicknesses thereof is unnecessary, it is possible to reduce the weight of the image forming device.

If the outer covering is opened in the direction parallel to the respective axes of the driver roller 73 and tension roller 71, the opening has to be large and hence the strengths of the frames 205 and 206 are decreased. This problem is particularly conspicuous in the case of a tandem image forming device.

On the other hand, if the outer covering is opened in the direction orthogonal to the axes of the drive roller 73 and tension roller 71, a mechanism for positioning and supporting the transfer belt unit 8 with respect to the main body of the image forming device can be downsized, compared to the case when the outer covering is opened in the direction parallel to the axes of the drive roller 73 and tension roller 71.

Further, the outer covering is opened in the direction orthogonal to the axes of the drive roller 73 and tension roller 71 both supporting the transfer belt unit 8, in other words, the outer covering is opened in the direction from the upstream to the downstream of the sheet transportation.

Thus, when paper jam occurs, a jammed sheet can be easily removed by grabbing a front or rear edge of the sheet and dragging out the sheet toward either the upstream or downstream of the sheet transportation. With this arrangement, it is possible to prevent the following problem: The sheet is torn on the occasion of dragging out so that a small piece of the sheet is remained in an unreachable part of the image forming device.

The following is a detailed description of the transfer belt unit 8 with reference to FIGS. 4 and 16-19.

Figure 16:
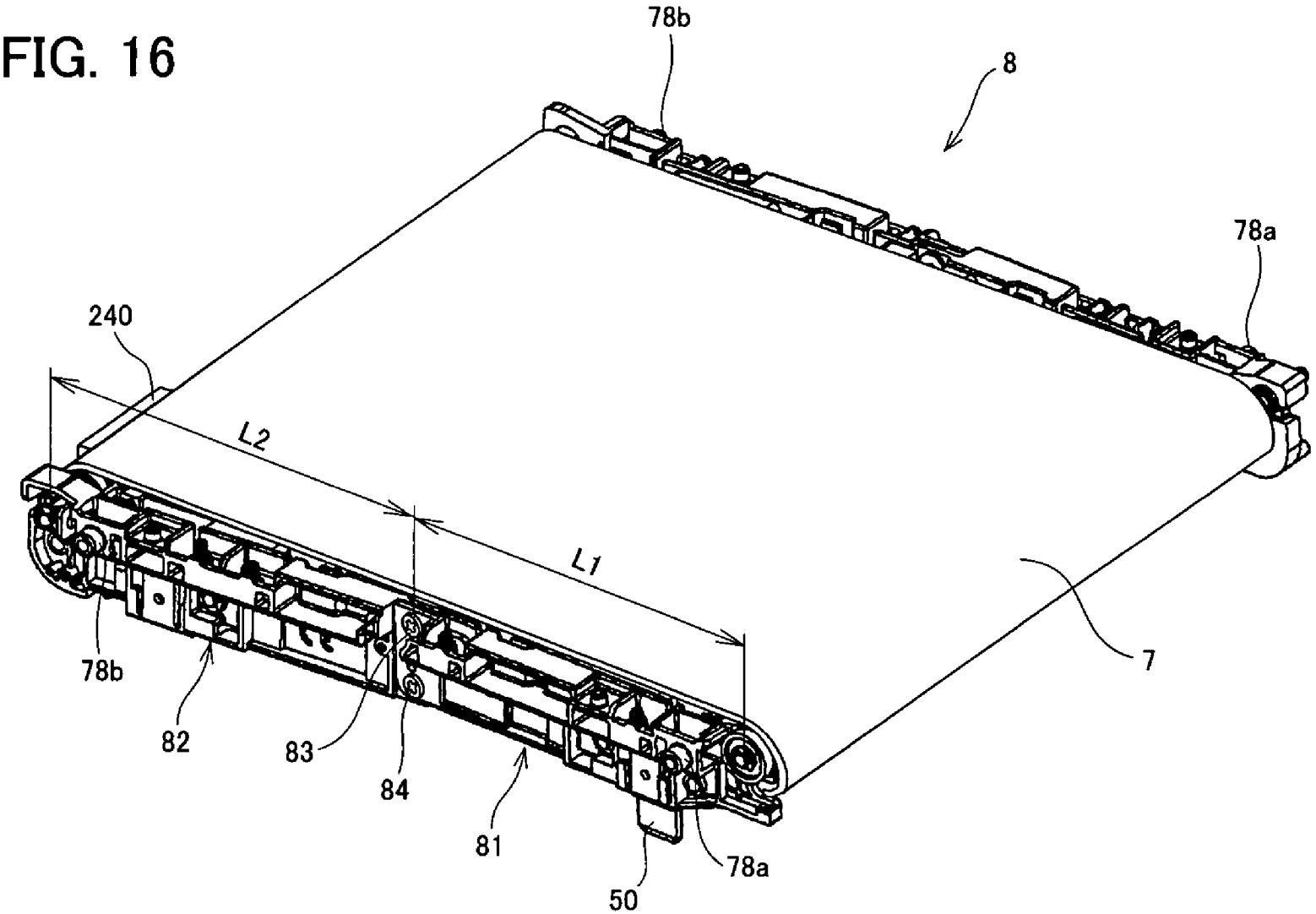
FIG. 16 is a perspective view, illustrating the transfer belt unit.

As FIG. 16 shows, the transfer belt unit 8 includes the transfer belt 7 which is an endless belt, a transfer supporting unit (hereinafter, supporting unit) 81 which is a belt unit, and a transfer belt supporting unit (hereinafter, supporting unit) 82 which is a belt unit.

The supporting unit 81 and supporting unit 82 are connected to each other at a below-mentioned connecting section 86. When the supporting units 81 and 82 are connected in a straight line, the transfer belt 7 is stretched around the supporting units 81 and 82.

Figure 17:
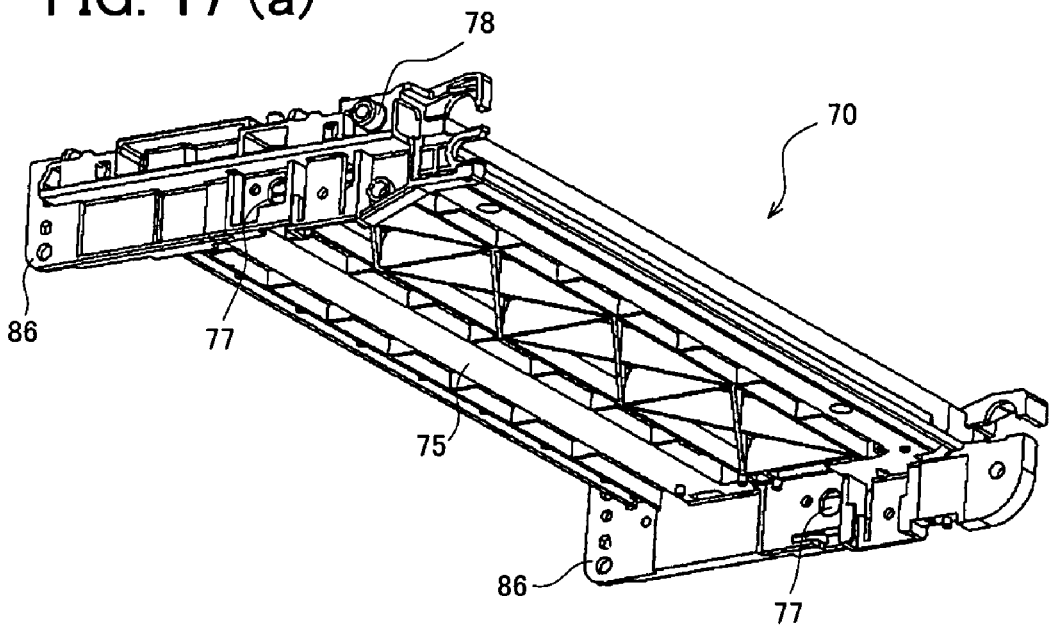
FIG. 17(*a*) is a perspective view from below, illustrating a housing of two supporting units connected with each other.
Figure 17:
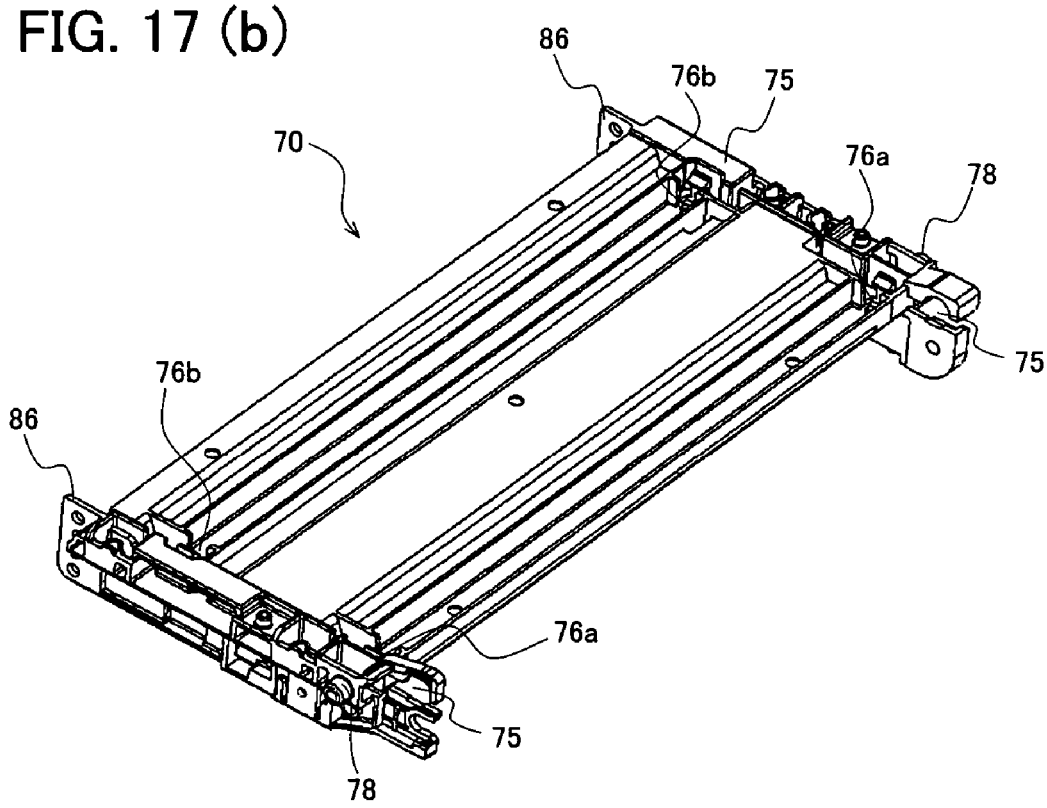

Also, as FIGS. 17(*a*) and 17(*b*) show, the supporting units 81 and 82 are provided in identical housings (base members) 70 as bases.

Further, as FIGS. 17(*a*) and 17(*b*) show, each of the housings 70 includes: a connecting section 86 having a hole through which a fastening member such as a screw and pin penetrates; roller attaching sections 75 for stretching the belt, which are for attaching the rollers for stretching the belt; and a supporting shaft 78 functioning as an axis section and supporting section. As FIG. 16 illustrates, the supporting shaft 78 of the supporting unit 81 is termed a supporting shaft 78*a*, while the supporting shaft 78 of the supporting unit 82 is termed a supporting shaft 78*b*.

As FIGS. 17(*a*) and 17(*b*) show, in the housing 70, one of the roller attaching sections 75 is provided at an end of the housing 70, and to this roller attaching section 75, a below-mentioned drive roller 71 (see FIG. 18(*b*)) or a transfer belt tension roller 73 (see FIG. 18(*a*)) is attached.

Furthermore, on a surface (top surface) of the housing 70, the surface facing a below-mentioned image forming station (see FIG. 4), transfer roller attaching sections 76*a* and 76*b* are provided for attaching the transfer rollers thereto, as FIG. 17(*b*) shows.

In the meantime, as FIG. 17(*a*) shows, on a surface (bottom surface) of the housing 70, the surface being opposite to the surface facing the image forming station, (i) transfer belt driven roller attaching sections 77 to which the transfer belt driven roller 72 or 74 is attached (see FIG. 4) and (ii) a roller attaching section 75 for stretching the belt, to which the transfer belt drive roller 71 or transfer belt tension roller 73 is attached (see FIGS. 18 and 22), are provided.

Thus, the supporting units 81 and 82 are formed by combining a plurality of members on the respective housings 70.

That is to say, as FIG. 18(*a*) shows, the supporting unit 82 is arranged in such a manner that, on the above-mentioned surface of the housing 70, the transfer belt tension roller (hereinafter, tension roller) 73 which is one of the roller members, transfer rollers 6*a* and 6*b* which are roller members, and a fixing plate which is a connecting member are provided.

The fixing plate 85 is provided on one side of the connecting section 86, and has a hole through which members such as the fastening member penetrates or by which screwing is carried out.

Figure 22:
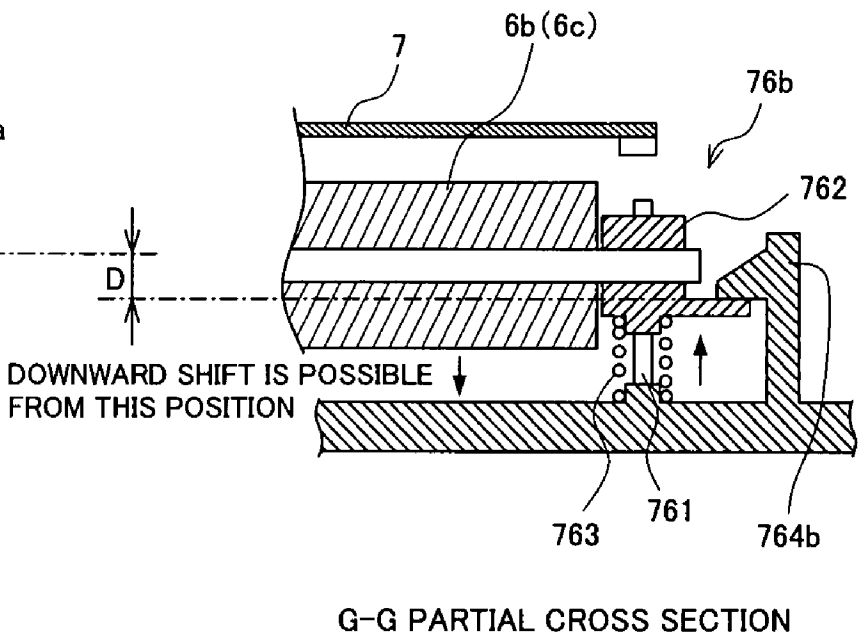
FIG. 22(*a*) is a cross section of a substantial part of two transfer rollers in FIG. 18(*a*), for comparing the height of these transfer rollers with each other.
Figure 22:
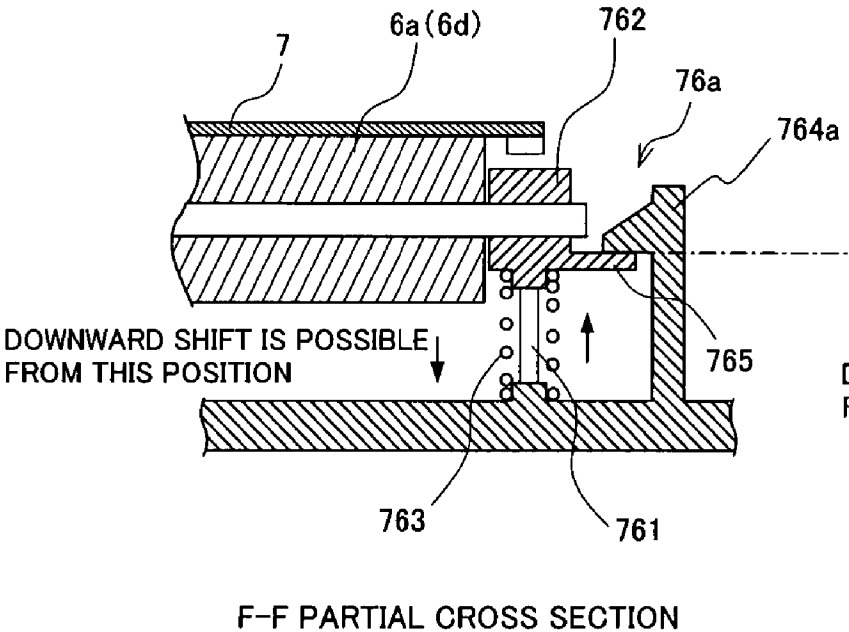

The tension roller 73 is attached to the roller attaching section 75 for stretching the belt, the roller attaching section 75 being provided at an end of the housing 70 (cf. FIG. 17(*a*)), and the transfer rollers 6*a* and 6*b* are attached to the respective transfer roller attaching sections 76*a* and 76*b* via sockets 762 (cf. FIG. 22). These rollers are, for instance, provided in the direction orthogonal to the axes so as to be movable in the up-and-down directions, and pushed in the upward direction (toward the image forming station) by a compression coil spring (elastic member) 763.

As FIG. 18(*b*) illustrates, the supporting unit 81 is arranged in such a manner that, on the above-mentioned surface of the housing 70, the transfer belt drive roller (hereinafter, drive roller) 71 which is the roller member, transfer rollers 6*c* and 6*d*, and a fixing plate 85 are provided. As in the case above, the fixing plate 85 is provided on the side identical with the connecting section 86 of the housing 70 of the supporting unit 82, and has a hole through which members such as the fastening member penetrates or by which screwing is carried out.

Then the drive roller 71 is attached to the roller attaching section 75 for stretching the belt, the roller attaching section 75 being provided at an end of the housing 75 (see FIG. 17(*b*)), and the transfer rollers 6*c* and 6*d* are attached to the respective transfer roller attaching sections 76*b* and 76*a*, as in the case of the supporting unit 82.

Further, on the back surfaces of the respective housings 70 of the supporting units 81 and 82, below-mentioned transfer belt driven rollers 72 and 74 are provided using transfer belt driven roller attaching sections 77 (see FIG. 4). In the present embodiment, the tension roller 73 and drive roller 71 also function as rollers for stretching the transfer belt 7.

Figure 19:
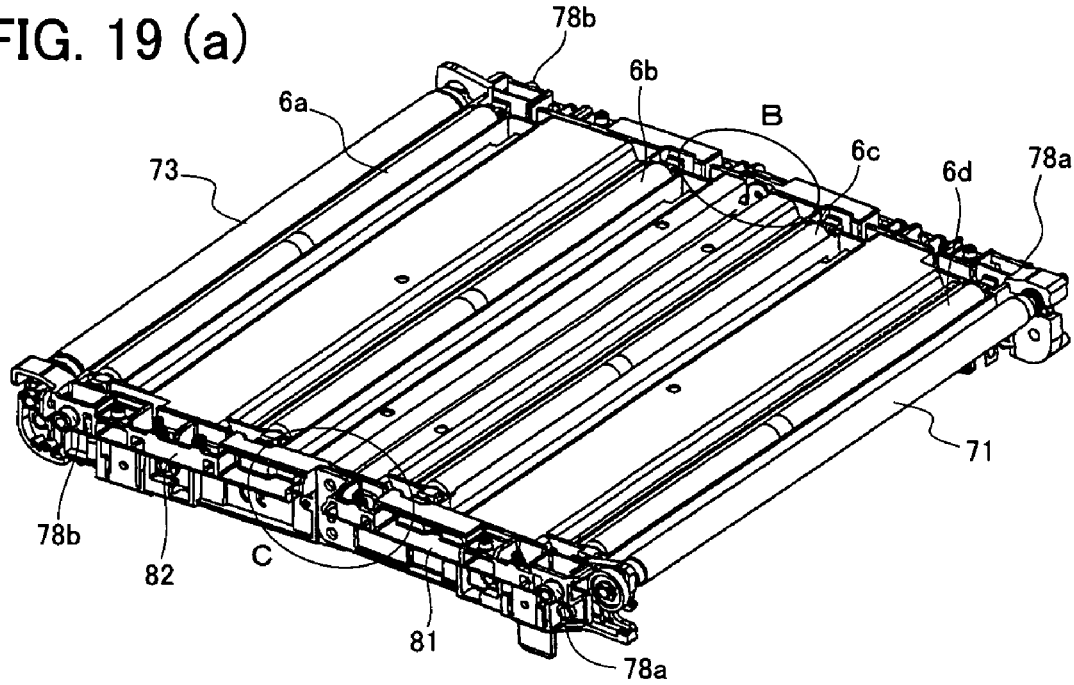
FIG. 19(*a*) is a perspective view, illustrating two housings connected with each other.
Figure 19:
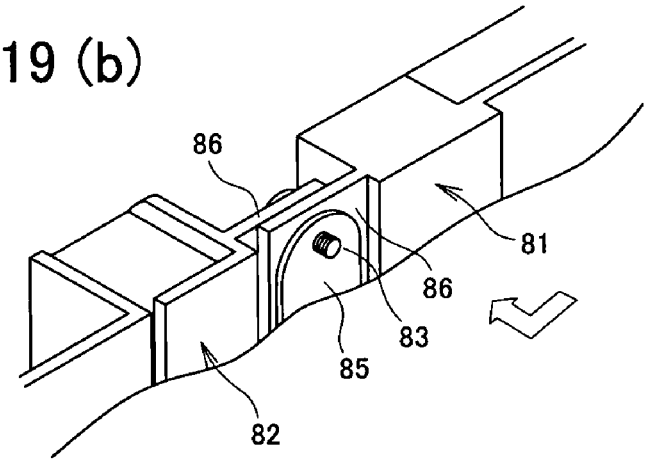
Figure 19:
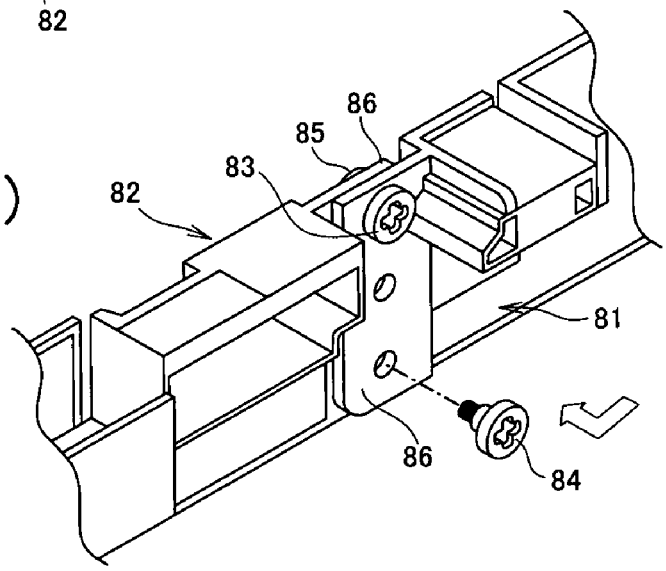

These supporting units 81 and 82 are connected with each other (FIG. 19(*a*)) by the connecting section 86 provided at the respective ends of the housings 70 shown in FIGS. 17(*a*) and 17(*b*). As FIG. 19(*a*) shows, the above-mentioned top surfaces of the respective housings 70 of the connected supporting units 81 and 82 form a single plane, while the above-mentioned bottom surfaces of the respective housings 70 form another single plane.

Figure 18:
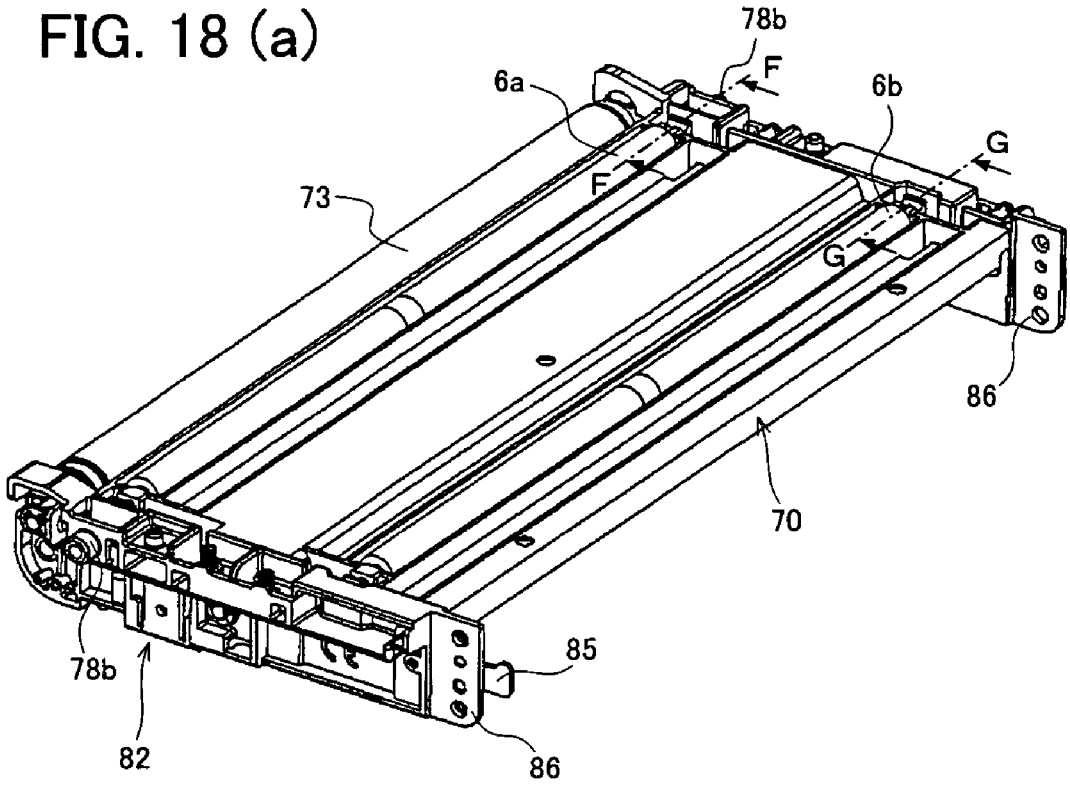
FIG. 18(*a*) is a perspective view from below, illustrating a housing with rollers.
Figure 18:
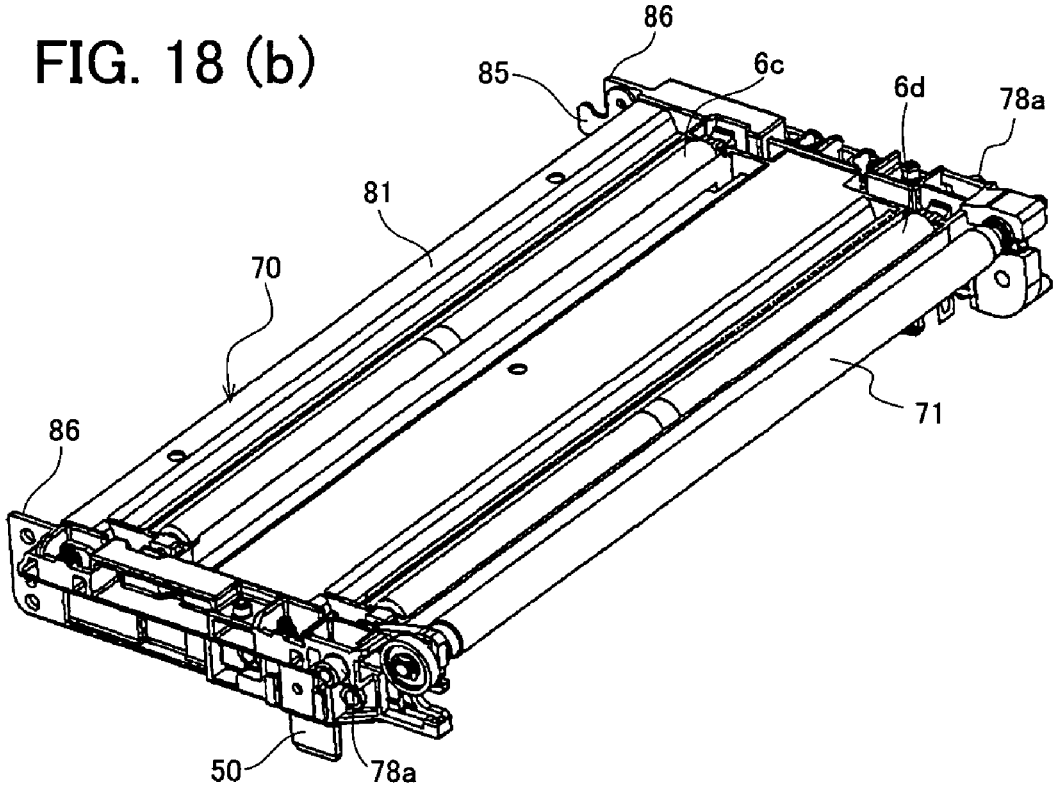

That is to say, as FIGS. 18(*a*) and 18(*b*) indicate, the housing 70 of the supporting unit 81 is connected to the housing 70 of the supporting unit 82 which is in-plane rotated for 180 degree.

With this arrangement, the fixing plate 85 of the supporting unit 81 is connected to the connecting section 86 of the supporting unit 82, this connecting section 86 being on the side where the fixing plate is not provided, while the fixing plate 85 of the supporting unit 82 is connected to the connecting section 86 of the fixing plate 85, this connecting section 86 being on the side where the fixing plate 85 if the supporting unit 81 is not provided.

More specifically, as arrows in FIGS. 19(*b*) and 19(*c*) indicate, the connecting section 86 of the supporting unit 81, the connecting section 86 having the fixing plate 85, is provided so as to be in touch with the inner surface of the connecting section 86 (see FIG. 19(*b*)) of the supporting unit 82, the connecting section 86 not having the fixing plate 85, while the supporting unit 82 having the fixing plate 85 is provided so as to be in touch with the inner surface of the connecting section 86 (see FIG. 19(*c*)) of the supporting unit 81, the connecting section 86 not having the fixing plate 85. In this manner, two supporting units 81 and 82 are connected with each other.

Then, as FIGS. 19(*b*) and 19(*c*) indicate, in these supporting units 81 and 82, the fixing plates 85 are connected with the connecting sections 86 by fastening two-stage screws 83 which are support fastening members (hereinafter, holding members) and two-stage screws 84 which are support fixing members (hereinafter, fixing members), which are inserted into corresponding holes. Note that, the two-stage screw has a shank with a small stage and a large stage.

When the two-stage screws 84 are removed and the two-stage screws 83 are loosened, the supporting units 81 and 82 can rotate about the two-stage screws 83 as axes.

In the present embodiment, the two-stage screws 83 are provided on the side of the top surfaces (upper side in the figure) of the housings 70 of the supporting units 81 and 82. Thus, since the supporting units 81 and 82 rotate about the two-stage screws 83 so that the respective surfaces of the housings 70 come close to each other, the supporting units 81 and 82 can be arranged so as to form a substantially V-shape.

When, as FIG. 19(*a*) shows, the supporting units 81 and 82 are arranged in a straight line, on the side of the bottom surfaces (lower side of FIG. 19(*c*)) of the housings 70, the fixing plates 85 and the connecting sections 86 of the supporting units 81 and 82 are fixed by inserting and fastening the two-stage screws 84. The fixing of the supporting units 81 and 82 in a straight line is further assured by fastening the two-stage screws 83.

Note that, the two-stage screws 83 and two-stage screws 84 are identical fastening members. With this arrangement, the number of parts is reduced so that the as-manufactured productivity is improved. When shaft members such as pins are adopted in place of the two-stage screws 83 and 84, the holes perforated through the fixing plates 85 and connecting sections 86 are arranged so as to be substantially identical in diameter with the shaft member, rather than screw holes having different diameters.

Further, since the inner diameters of the holes perforated through the connecting sections 86 are substantially identical with the diameters of the large stages of the corresponding two-stage screws 83 and 84, it is possible to precisely carry out the connection. While the fixing plate 85 can be certainly fixed to the connecting section 86 by firmly fastening the two-stage screws 83 and 84, the supporting units 81 and 82 can be arranged so as to be rotatable, by loosening and removing either one of the two-stage screws.

Note that, the two-stage screws 83 and 84 may be different fastening members rather than identical ones, and fasting members such as typical screws may be adopted thereto.

Further, the two-stage screws 83 are not necessarily provided in the connecting sections 86 on the side of the top surface of the housing 70, as long as the two-stage screws 83 can function as axes about which the supporting units 81 and 82 rotate so as to form a V-shape.

That is to say, to cause the respective back surfaces of the housings 70 of the supporting units 81 and 82 to face each other, the two-staged screws 83 may be provided at the positions where the two-stage screws 84 are provided in the example above.

In the present embodiment, the tension roller 73 attached to the roller attaching section 75 for stretching the belt functions as a belt tensioner. However, the present invention is not limited to this arrangement so that the transfer belt driven roller 72 attached to the belt driven roller attaching section 77 may function as a belt tensioner.

In the transfer belt unit 8, as FIG. 16 illustrates, a receiving connector 240 which does not obstruct the attaching/detaching of the transfer belt 7 and carries out transmission and receives electricity is provided on the side of the supporting shaft 78*b*, the side not being moved so much on the occasion of switching the image forming mode.

As described above, since identical housings 70 are adopted as base members, the supporting unit 81 is substantially identical in size with the supporting unit 82.

For this reason, as FIG. 16 shows, a length L2 between the two-stage screw 83 which is the axis of the connecting section 86 of either the supporting unit 81 or 82 and the tension roller 73 (see FIG. 18(*a*)) provided at the end of the supporting unit 81 is substantially identical with a length L1 between the two-stage screw 83 and the drive roller 71 provided at the end of the supporting unit 82.

Moreover, the transfer belt unit 8 is, as FIG. 16 shows, arranged in such a manner that, when two supporting units 81 and 82 in which the length L1 is identical with the length L2 are arranged so as to form a straight line, and the transfer belt 7 surrounds these supporting units 81 and 82. The transfer belt 7 is stretched by the drive roller 71 and tension roller 73 which are provided at the respective ends of the transfer belt unit 8.

Figure 20:
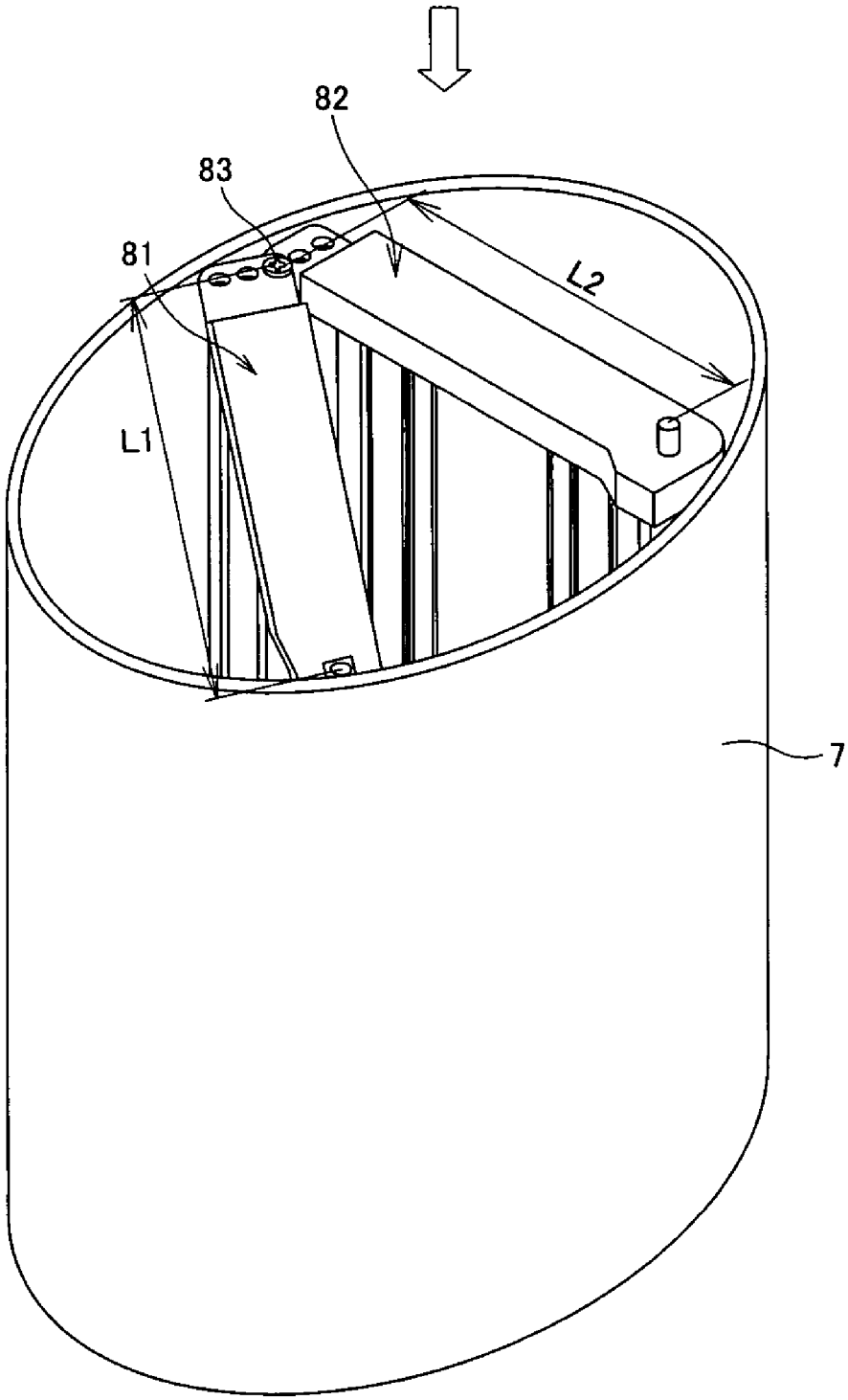
FIG. 20 illustrates the transfer belt unit when the supporting unit is caused to be substantially V-shaped.
Figure 21:
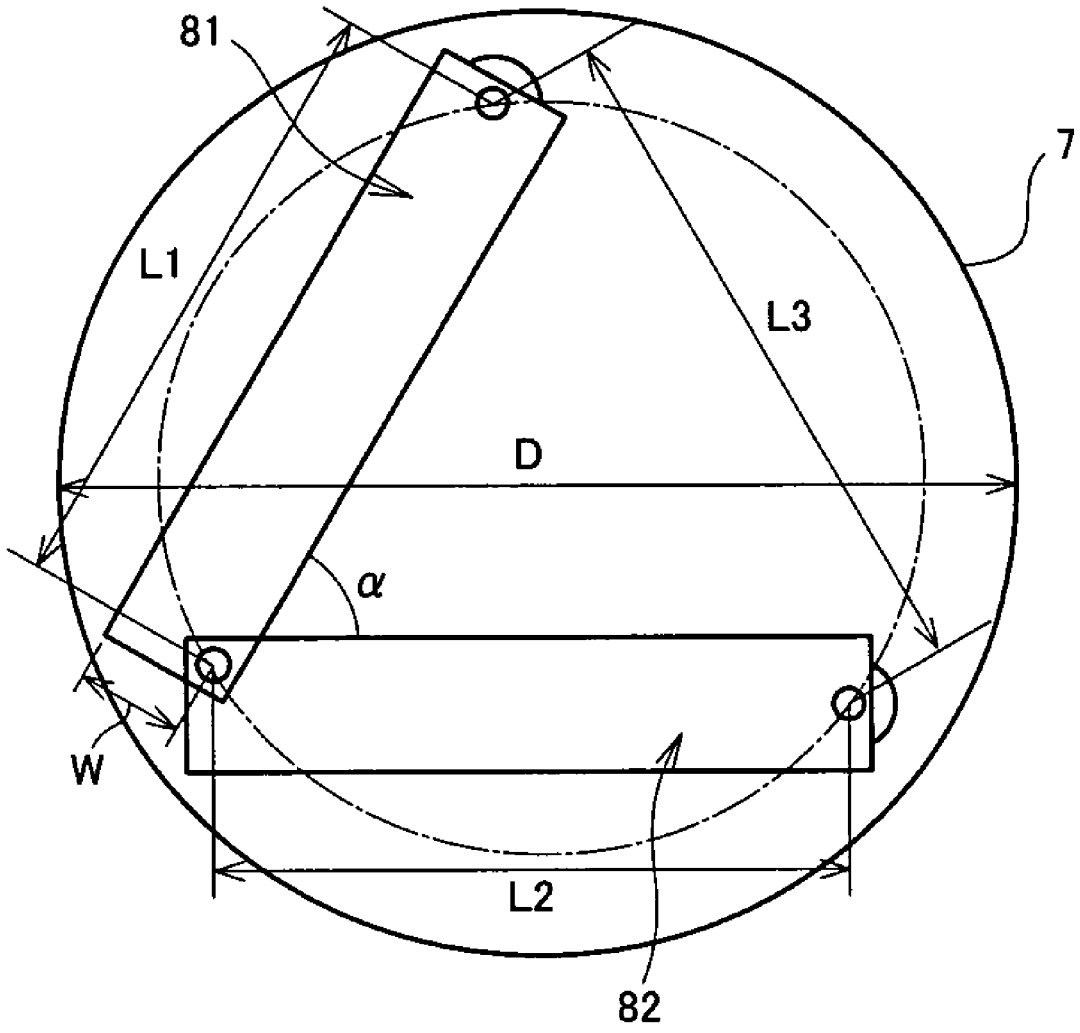
FIG. 21 illustrates a condition that two housings are placed in a substantially V-shaped manner.

The following will describe the operations to attach/detach the transfer belt 7 to/from the supporting units 81 and 82, performed on the occasion of replacing the transfer belt 7, with reference to FIGS. 16, 20, and 21.

As FIG. 16 shows, when the transfer belt unit 8 operates, the transfer belt 7 is supported so as to be stretched around the supporting units 81 and 82. Thus, to stretch the transfer belt 7, first of all, the two-stage screws 84 (see FIG. 19(*c*)) fixing the supporting units 81 and 82 are removed, and the two-stage screws 83 are loosened. Then, as FIG. 20 illustrates, the supporting units 81 and 82 are caused to pivot about the two-stage screws 83, and form a substantially V-shape.

Since the two-stage screws 83 are provided on the side of the upper surfaces of the housings 70 of the supporting units 81 and 82, the supporting units 81 and 82 are folded so that the top surfaces thereof come close to each other.

Subsequently, around the substantially V-shaped supporting units 81 and 82, as FIG. 20 shows, the transfer belt 7 is provided from the direction indicated by an arrow. Since the supporting units 81 and 82 are folded at this moment, the supporting units 81 and 82 can be inserted in the loop of the transfer belt 7.

Then, about the two-stage screws 83 as axes, the supporting units 81 and 82 are caused to rotate in the directions of causing the top surfaces of the supporting units 81 and 82 to distance from each other, i.e. in the directions opposite to the directions of folding the supporting units 81 and 82. Rotating the supporting units 81 and 82 in this manner, the supporting units 81 and 82 are caused to be arranged in a straight line, so that, as FIG. 16 illustrates, the transfer belt 7 is supported and stretched around the supporting units 81 and 82.

In this state, the drive roller 71 and tension roller 73 are located at the both ends of the transfer belt unit 8. Then a tensioning member 79 (see FIG. 4) which is composed of members such as a coil spring and provided on the tension roller 73 causes the transfer belt 7 to be under tension, so that the transfer belt 7 is stretched.

Further, after the supporting units 81 and 82 are arranged in a straight line, these supporting units 81 and 82 are fixed using the two-stage screws 84. With this arrangement, the transfer belt 7 is kept to be tensioned.

Moreover, in this state, the transfer rollers 6*a*, 6*b*, 6*c*, and 6*d* (see FIG. 19(*a*)) push up the transfer belt 7. Since the transfer rollers 6*b* and 6*c* are provided at positions slightly higher than a straight line connecting the top end of the drive roller 71 and the top end of the tension roller 73, the transfer rollers 6*a* and 6*d* further push up the transfer belt 7, compared to the transfer rollers 6*b* and 6*c*. For this reason, the transfer rollers 6*b* and 6*c* are not in touch with the back surface of the transfer belt 7.

This arrangement is realized by differentiating the vertical positions of socket regulating sections of the respective transfer roller attaching sections 76*b* and 76*a* to which the sockets 762 which support the transfer rollers 6*a*-6*d* to be rotatable are attached (cf. FIG. 22). The vertical positions of the socket regulating sections will be discussed later.

In this manner, since the supporting units 81 and 82 are arranged so that the lengths L1 and L2 in FIGS. 16 and 20 are substantially identical, the attaching/detaching the transfer belt 7 to/from the supporting units 81 and 82 can be easily carried out. This is because, when the supporting units 81 and 82 are arranged so as to be substantially V-shaped, the perimeter of the circle circumscribing the supporting units 81 and 82 is shortest when the lengths L1 and L2 are identical.

That is to say, in the present embodiment, since the above-mentioned lengths L1 and L2 are substantially identical, the perimeter of the circle enclosing the supporting units 81 and 82 (hereinafter, this perimeter will be referred to as the approximate perimeter of the supporting units 81 and 82) can be arranged to be the shortest.

Thanks to this arrangement, the difference between the peripheral length of the transfer belt 7 and the approximate perimeter of the supporting units 81 and 82 is large, and this causes the transfer belt 7 to be easily attached or detached.

The following will specifically describe the difference between the peripheral length of the transfer belt 7 and the approximate perimeter of the supporting units 81 and 82, by taking, as an example, a case that each of the lengths L1 and L2 of the supporting units 81 and 82 is about 165 mm and the perimeter of the transfer belt 7 is about 730 mm, with reference to FIG. 21. Note that, in the example, the thicknesses of the respective supporting units 81 and 82, which are indicated as W in FIG. 21, are about 35 mm.

As FIG. 16 shows, when the supporting units 81 and 82 are arranged in a straight line, the perimeter of the supporting units 81 and 82 corresponds to the perimeter of the transfer belt 7, so that the transfer belt 7 is stretched around the supporting units 81 and 82 so as to be rotatable.

Meanwhile, as FIG. 20 illustrates, when the supporting units 81 and 82 are arranged so as to be substantially V-shaped, the tension on the transfer belt 7 is loosened. As FIG. 21 shows, when the transfer belt 7 is in a circle, a diameter D of the circle is about 233 mm.

In this state, as FIG. 21 shows, provided that an interior angle $\alpha$ between the supporting units 81 and 82 is 60°, the lengths L1 and L2 of the supporting units 81 and 82 can be seen as two sides of an equilateral triangle. In other words, the lengths L1, L2, and L3 in FIG. 21 are identical. Thus, since this triangle is 165 mm on a side, the diameter of a circle circumscribing the triangle, which is indicated by a dashed line in FIG. 21, is about 190.5 mm. In this example, the length L3 indicate the remaining side of the triangle in which the supporting units 81 and 82 constitute two sides thereof.

Since the supporting units 81 and 82 have members such as the drive roller 71 and tension roller 73 (see FIGS. 18(*a*) and 18(*b*)), the above-mentioned diameter in reality is a little longer than 190.5 mm.

Taking into consideration of the outer shape of the drive roller 71 and tension roller 73 and the thickness W (see FIG. 21) of the supporting units 81 and 82, it is considered that the approximate perimeter of the supporting units 81 and 82 is about 220 mm at the maximum.

The diameter D of the transfer belt 7 is about 233 mm as described above, and is sufficiently larger than the approximate perimeter of the supporting units 81 and 82 (220 mm). Thus, as FIG. 20 shows, since the folded supporting units 81 and 82 can be fitted in the circle of the transfer belt 7, the transfer belt 7 can be easily attached/detached when replacing the same.

Note that, it is preferable that the interior angle $\alpha$ between the folded supporting units 81 and 82 is as small as possible. However, to set the angle $\alpha$ to be 0, the connecting sections 86 have to be arranged so as to protrude from the bottom surfaces of the supporting units 81 and 82, when the supporting units 81 and 82 are arranged in a straight line.

Thus, in the present embodiment, the angle α is set to be about 60° in order to avoid the connecting sections 86 to protrude when the supporting units 81 and 82 are arranged in a straight line.

Figure 4:
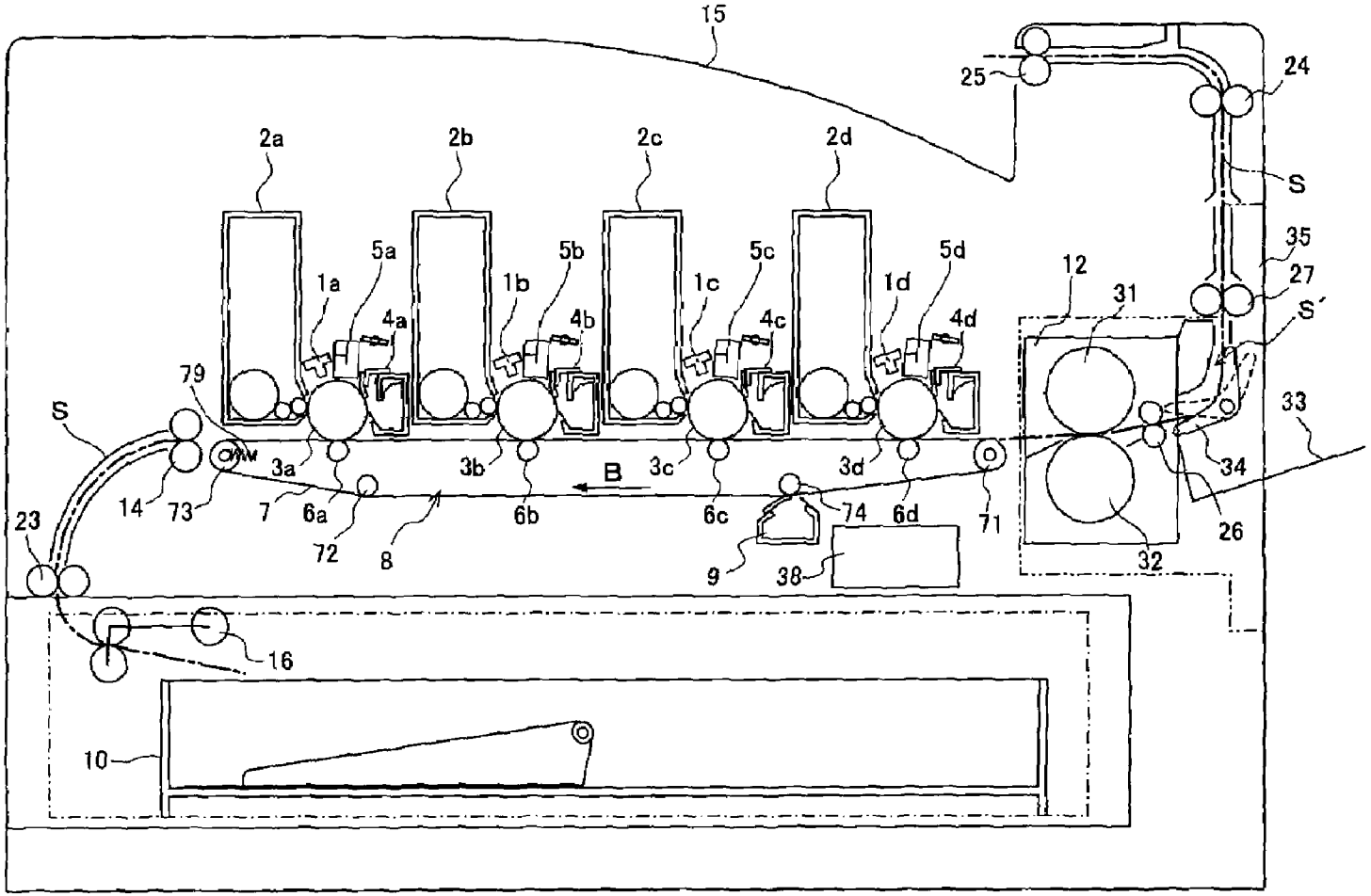
FIG. 4 illustrates a substantial part of the image forming device.

The following will describe an image forming device including the above-described transfer belt unit 8, with reference to FIG. 4.

The image forming device in FIG. 4 is typically provided in devices such as a photocopier in FIG. 23 having an image forming device and sheet feeding device.

The image forming device of the present embodiment forms a multicolor or monochrome image on a predetermined sheet (recording medium). The image forming device includes members such as exposure units 1 (1*a*-1*d*), developing units 2 (2*a*-2*d*), photosensitive drums 3 (3*a*-3*d*), charging units 5 (5*a*-5*d*), cleaner units 4 (4*a*-4*d*), a transfer belt unit 8, a fixing unit 12, a sheet transport path S, a sheet feeding tray 10, and sheet output trays 15 and 33.

Note that, image data used in the present image forming device supports color images consisted of black (K), cyan (C), magenta (M), and yellow (Y).

Thus, the numbers of the exposure units 1 (1*a*, 1*b*, 1*c*, and 1*d*), developing units 2 (2*a*, 2*b*, 2*c*, and 2*d*), photosensitive drums 3 (3*a*, 3*b*, 3*c*, and 3*d*), charging units 5 (5*a*, 5*b*, 5*c*, and 5*d*), and cleaner units 4 (4*a*, 4*b*, 4*c*, and 4*d*) are four, in order to form four types of electrostatic images corresponding to respective colors. The members with a sign "a" correspond to black, the members with a sign "b" correspond to cyan, the members with a sign "c" correspond to magenta, and the members with a sign "c" correspond to yellow, and the members having the same sign constitute one image forming station, and thus there are four image forming stations.

The photosensitive drums 3 are provided almost at the center of the image forming device, and each having a photoreceptor on its surface. Each of the photosensitive drums 3 is drum-shaped and rotatable. Around the photosensitive drum 3, the charging unit 5, developing unit 2, transfer roller 6, and cleaner unit 4 are provided. The order of these members 3, 5, 2, 6, and 4 corresponds to the rotative direction of the photosensitive drum 3.

The charging unit 5 is a charging means for causing the surface of the photosensitive drum to be uniformly charged with a predetermined electric potential. As the charging unit 5, a charger-type charging unit as illustrated in FIG. 4 can be adopted, apart from roller-type or blush-type ones.

Although the present embodiment adopts an LED write head as the exposure unit 1, the present invention is not limited to this arrangement and hence, for instance, as the exposure unit 1, devices such as an EL (electroluminescence) device including arrayed light emitting elements and a laser scanning unit (LSU) having a laser irradiator section and reflective mirror may be adopted.

The exposure unit 1 also has such a function of forming an electrostatic latent image on the surface of the photosensitive drum 3, by exposing the charged photosensitive drum 3 in accordance with supplied image data.

The developing unit 2 visualizes the latent image formed on respective photosensitive drum, using toners of (K, C, M, Y).

The cleaner unit 4 removes and retrieves the toner remaining on the surface of the photosensitive drum 3, after the development and transfer of the image.

As described above, the transfer belt unit 8 below the photosensitive drums 3 has two supporting units 81 and 82 (cf. FIG. 16). That is to say, the transfer belt unit 8 includes the transfer belt 7, drive roller 71, tension roller 73, transfer belt driven rollers 72 and 74, and transfer rollers 6 (6*a*, 6*b*, 6*c*, and 6*d*). Further, being adjacent of the transfer belt unit 8, a transfer belt cleaning unit 9 is provided.

The members such as the drive roller 71, tension roller 73, transfer rollers 6, and transfer belt driven rollers 72 and 74 are provided for causing the transfer belt 7 to stretch and rotate in the direction indicated by an arrow B.

The transfer rollers 6 are supported by the transfer roller attaching sections 76*a* and 76*b* of the housings 70 of the transfer belt unit 8 so as to be rotatable. The transfer rollers 6 apply a transfer bias for transferring toner images (images) on the photosensitive drums 3 to a sheet (recording medium) which has been adsorbed on the transfer belt 7 and transported.

The transfer belt 7 is an endless film about 100-150 μm thick, and arranged so as to be in touch with the photosensitive drums 3. The transfer belt 7 produces a color (multicolor) toner image by serially transferring and overlaying the toner images of respective colors formed on the photosensitive drums 3 onto a sheet.

The transfer of the toner images from the photosensitive drums 3 onto the sheet is carried out by the transfer rollers 6 being in touch with the back surface of the transfer belt 7. To the transfer rollers 6, a high-voltage transfer bias (a high voltage having a polarity (+) opposite to the polarity (−) of the toner) is applied in order to transfer the toner images.

Each of the transfer rollers 6 is made in such a manner that a metal (e.g. stainless) shaft 8-10 mm in diameter is covered with a conductive elastic material (e.g. EPDM or urethane form). Having the conductive elastic material thereon, the transfer rollers 6 can uniformly apply a high voltage to the sheet. Although the present embodiment adopts the transfer rollers 6 as transfer electrodes, members such as brushes may be adopted as the transfer electrodes.

Since the toner adhered to the transfer belt 7 due to the contact with the photosensitive drums 3 may contaminate the back surface of a recording sheet, the transfer belt cleaning unit 9 is provided for removing and retrieving the toner. The transfer belt cleaning unit 9 has, for instance, a cleaning blade as a cleaning member being in touch with the transfer belt 7, and the transfer belt 7 with which the cleaning blade is in contact is supported by the transfer belt driven roller 74 from the back side.

The sheet feeding tray 10 is a tray for storing sheets for image formation, and provided below the image forming section of the image forming device. The sheet output tray 15 provided above the image forming device is a tray for supporting the printed sheets with their top surfaces down, while the sheet output tray 33 provided alongside the image forming device is a tray on which the printed sheets are provided with their top surfaces up.

The image forming device is further provided with the S-shaped sheet transport path S for transporting the sheets on the sheet feeding tray 10 to the sheet output tray 15 via the transfer belt unit 8 and fixing unit 12. Moreover, in the vicinity of the sheet transport path S extending from the sheet feeding tray 16 to the sheet output tray 15 and sheet output tray 33, members such as a pickup roller 16, sheet transport roller 23, resist roller 14, fixing unit 12, transport direction switching guide 34, transport rollers 26, 24, and 27 for transporting sheets, and sheet output roller 25 are provided.

The pickup roller 16 is provided at an end of the sheet feeding tray 10, for supplying sheets from the sheet feeding tray 10 toward the sheet transport roller 23 of the sheet transport path S on a one-by-one basis.

The transport direction switching guide 34 is provided on the side cover 35 so as to be rotatable. By switching the transport direction switching guide 34 from the state indicated in a full line to the state indicated by a dotted line, the sheet is detached from the midstream of the transport path S and can be discharged to the sheet output tray 33. When the transport direction guide 34 is in the state indicated in the full line, the sheet passes through a transport path S' (a part of the sheet transport path S) between the fixing unit 12, side cover 35, and transport direction guide 34, and eventually discharged to the sheet output tray 15 by the sheet output roller 25.

The resist roller 14 is provided for temporarily keeping the sheet being transported on the sheet transport path S. To suitably transfer and overlay the toner images formed on the photosensitive drums 3, the resist roller 14 adjusts the timing of the sheet transportation to correspond to the rotation of the photosensitive drums 3.

That is to say, the resist roller 14 aligns the respective front edges of the toner images on the photosensitive drums 3 with the front edge of an image forming area of the sheet, in reference to a detection signal from a before-resist detection switch (not illustrated).

The fixing unit 12 includes members such as a heat roller 31 and pressure roller 32, and the heat roller 31 and pressure roller 32 clip the sheet and rotate.

Further, the heat roller 31 is kept at a predetermined fixing temperature by a control section in accordance with a signal from a temperature detection device (not illustrated). By subjecting the sheet to thermo-compression bonding, The heat roller 31 as well as the pressure roller 32 fuse, mix, and pressurize the multicolor toner image having been transferred on the sheet so as to heat-fix the image on the sheet.

The sheet on which the multicolor toner image have been fixed is transported through a reverse sheet discharging path of the sheet transport path S by the transport rollers 26, 27, and 24, and then discharged onto the sheet output tray 15 with its top surface down (i.e. in the state that the multicolor toner image on the sheet faces the sheet output tray 15).

The following will describe the operations of detaching/attaching the transfer belt unit 8 from/to the image forming stations.

First of all, the relationship between the detaching/attaching operations and the transfer rollers 6 will be discussed.

The supporting shafts 78 (78*a* and 78*b*) shown in FIGS. 17(*a*) and 17(*b*) function as rotative axes and aligning members when carrying out the operations of detaching/attaching the transfer belt unit 8 from/to the image forming stations. As FIGS. 17(*a*), 17(*b*), 18(*a*), and 18(*b*) illustrate, the supporting shafts 78 are provided in the housing 70 and substantially on the extension of the axis of the transfer roller 6*a*. The supporting shafts 78 are provided on the both sides of each of the supporting units 81 and 82, that is, two supporting shafts 78 are provided in each of the supporting units.

The supporting shafts 78*a* and 78*b* are, as FIG. 3 shows, provided on the rail members 201 mounted on the inner surfaces of the front and rear frames 205 and 206 which are frame members of the main body of the image forming device (see FIG. 15). That is to say, the supporting shafts 78*b* are fitted in the positioning holes 202*b* so as to function as rotation axes, while the supporting shafts 78*a* are pushed onto the notches 202*a* for determining the positions.

With this arrangement, the positioning of the transfer belt unit 8 is determined with respect to the rail members 201, and the supporting shafts 78*b* fitted in the positioning holes 78*b* function as the rotation axes. In this manner, the transfer belt unit 8 is supported at the positioning holes 202*b* and can rotate about the supporting shafts 78*b* as rotation axes.

FIG. 22 is an enlarged view, illustrating a F-F partial cross section and G-G partial cross section in FIG. 18 and the transfer belt 7. As in this figure, the transfer roller 6*a* is supported by the sockets 762 which are attached to respective socket supporting sections 761 of the transfer roller attaching sections 76*a* formed in the housing 70 of the supporting unit 82 and can move in the up-and-down directions, and thus the transfer roller 6*a* is rotatable and can move in the up-and down directions.

Each of the transfer roller attaching sections 76*a* is pushed by, for instance, the compression coil spring 763, toward the transfer belt 7 (i.e. upward). Thus, at the transfer roller attaching section 76*a*, the axis of the transfer roller 6*a* can move in the up-and-down directions.

With this arrangement, when the transfer belt unit 8 is subjected to the detaching/attaching operations in order to switch the image forming mode, the transfer roller 6*a* can move independently of the movement of the supporting shafts 78*b*, and hence the contact between the transfer belt 7 and photosensitive drums 3 can be always kept stable at a predetermined nip width and pressure.

In this state, the axes of the supporting shafts 78*b* are substantially on the extension of the axis of the transfer roller 6*a*, and this prevents the function of the transfer roller 6*a* from being impaired after the transfer belt unit 8 is subjected to the detaching/attaching operations for switching the image forming mode (cf. FIG. 5).

Meanwhile, the remaining transfer rollers 6*b*, 6*c*, and 6*d* are also movable in the up-and-down directions, independently of the movement of the transfer roller attaching sections 76*b* or 76*a*.

Figure 6:
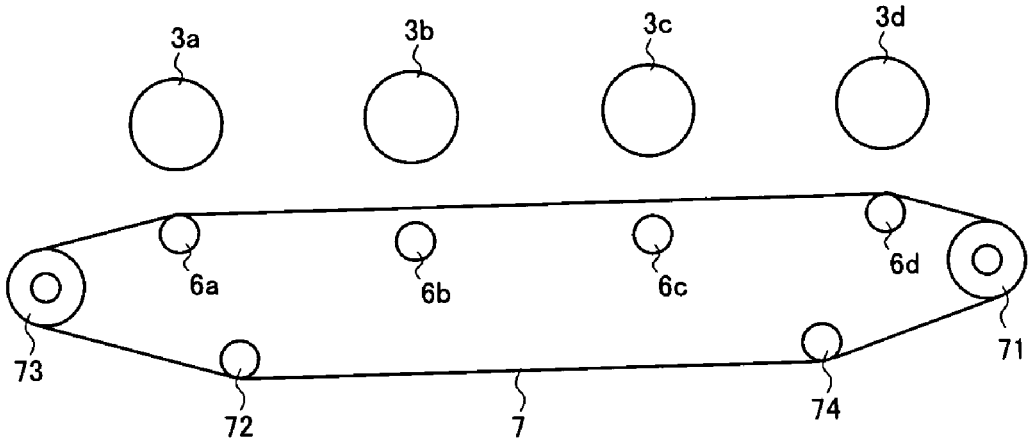
FIG. 6(*a*) illustrates the placement of a photosensitive drum and the transfer belt unit, when the transfer belt unit is in the free state.
Figure 6:
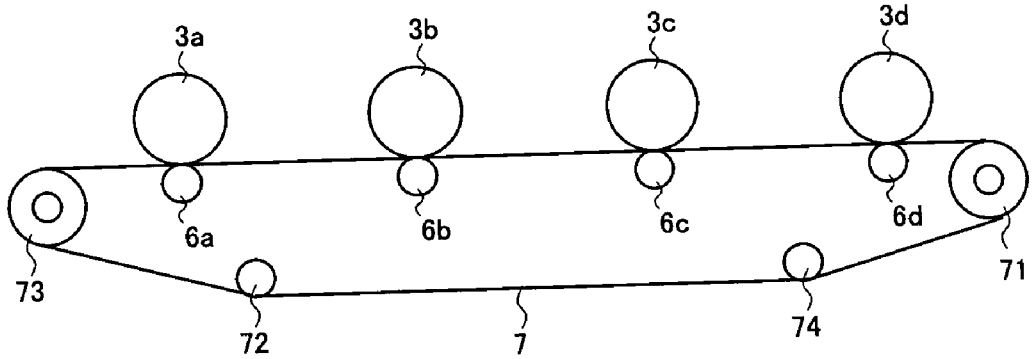
Figure 6:
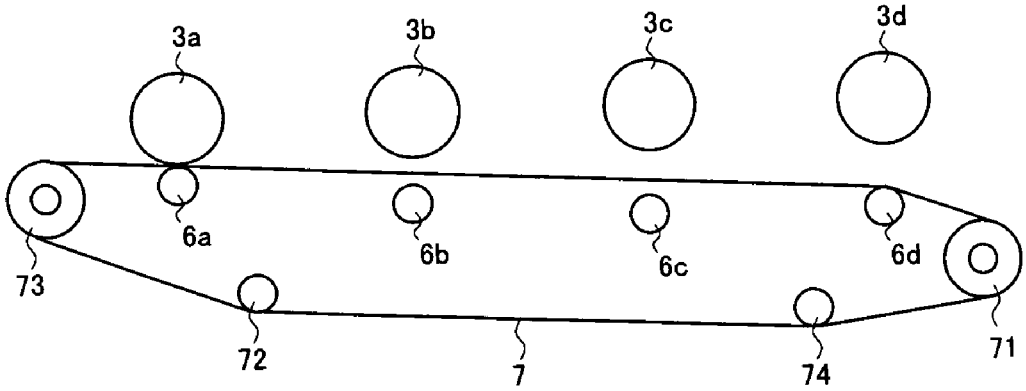

With this arrangement, as FIG. 6(*b*) shows, when the image forming mode (multicolor mode) with which the photosensitive drums 3*a*-3*d* are in touch with the transfer belt 7 is selected, the contact between the transfer belt 7 and photosensitive drums 3*a*-3*d* can be kept at a predetermined nip width and pressure.

Further, as FIG. 22 illustrates, the transfer roller attaching sections 76*a* and 76*b* are provided with regulating members 764*a* and 764*b*, respectively. Each of the regulating members 764*a* and 764*b* regulates the free height of the transfer roller 6. The regulation of the free height is carried out when the transfer roller 6 is engaged with a hook section 765 of the socket 762 which supports the transfer roller 6 to be rotatable and movable in the up-and-down directions so that the photosensitive drums 3 is distanced from the transfer belt 7. The tolerance in the case of the regulating member 764 attached to the transfer roller attaching section 76*a* is different from the tolerance in the case of the regulating member 764 attached to the transfer roller attaching section 76*b*.

That is to say, the free height of the regulating member 764*a* formed in the transfer roller attaching section 76*a* is arranged so as to be higher than the free height of the regulating member 764*b* formed in the transfer roller attaching section 76*b*, and the vertical positions of the transfer rollers 6*a* and 6*d* are arranged so as to be higher than the vertical positions of the drive roller 71 and tension roller 73 provided at the both ends of the transfer belt unit 8.

In the present embodiment, a difference D between the free height of the transfer rollers 6*a* and 6*d* and the free height of the transfer rollers 6*b* and 6*c* is set at about 1.5-3 mm. However, the difference D can be arbitrarily set as long as the transfer belt unit 8 is not in contact with the transfer rollers 6*b* and 6*c*.

With this arrangement, as FIG. 6(*a*) shows, when the support of the transfer belt unit 8 is released, the vertical positions of the transfer rollers 6*a* and 6*d* are higher than those of the drive roller 71 and tension roller 73 provided at the both ends, while the vertical positions of the transfer rollers 6*b* and 6*c* are lower than those of the transfer rollers 6*a* and 6*d*. Thus, the photosensitive drums 3 are not in touch with the transfer belt 7.

In this state, the distance between the transfer belt 7 and the photosensitive drums 3 is set at about 12 mm in the present embodiment, and hence the photosensitive drums 3 are sufficiently distanced from the transfer belt 7. For this reason, when the photosensitive drums 3 or transfer belt 7 are/is replaced, it is possible to draw out the target member(s) without interfering units including these members.

The free heights of the transfer rollers 6*a*-6*d* are differentiated as above, in order to avoid the following problem: As FIG. 6(*c*) shows, when the image forming mode (monochrome mode) with which the photosensitive drums 3*b*, 3*c*, and 3*d* are not used for the image formation is adopted, the contact between (i) the transfer rollers 6*b*-6*d* corresponding to the photosensitive drums 3*b*, 3*c*, and 3*d* not used for the image formation and (ii) the transfer belt 7 is deteriorated, in particular, the contact between (I) the contact between the transfer rollers 6*b* and 6*c* provided at the central part of the transfer belt unit 8 and (II) the transfer belt 7 is significantly deteriorated.

For instance, provided that the transfer rollers 6*a*-6*d* are provided at the same vertical position, even if the transfer belt 7 rotates, the transfer rollers 6*b* and 6*c* are not driven by the transfer belt 7 because of the lack of frictional force. For this reason, the transfer rollers 6*b* and 6*c* are irregularly worn, thereby causing troubles such that the lifespan of the transfer rollers 6*b* and 6*c* is shortened and the transfer is irregularly done.

In the image forming mode such as the monochrome mode, with which some of the image forming sections (image forming stations) do not operate, the detaching/attaching of the transfer belt unit 8 causes the transfer rollers 6*b* and 6*c* provided at the central part of the transfer belt unit to be distanced from the transfer belt 7, so that the irregular wear of the transfer rollers 6 can be prevented, the lifespan of the transfer rollers 6 can be elongated, and the image formation is suitably carried out for a long period of time.

In this manner, to solve the above-mentioned problems, the image forming device includes: the photosensitive drums 3 on which images are formed in accordance with image data; and the transfer belt unit 8 which is detachable/attachable from/to the photosensitive drums 3 and includes the transfer belt 7 receiving a voltage from the transfer rollers (transfer members) and transferring the images. Further, a plurality of the photosensitive drums 3 are provided in the direction orthogonal to the axes of the drive roller 71 and tension roller 73 (roller members), and there are two image forming modes, namely, (i) the image forming mode (multicolor mode) with which all of the photosensitive drums 3 are in contact with the transfer belt 7 and used for the image formation and (ii) the image forming mode (monochrome mode) with which only predetermined ones of the photosensitive drums 3 are in contact with the transfer belt 7 and used for the image formation. When the monochrome mode is selected, the transfer rollers 6*b* and 6*c* which correspond to the unused photosensitive drums 3 and not provided at the both ends are not in touch with the transfer belt 7.

Generally speaking, when the image forming mode (monochrome mode) with which an only predetermined one of the photosensitive drums 3 (photosensitive drum 3*a* in this example) is used is adopted, the contact between the transfer rollers 6*b*-6*d* corresponding to the photosensitive drums 3*b*-3*d* not being used for the image formation and the transfer belt 7 is deteriorated, and in particular, the contact between the transfer rollers 6*b* and 6*c* which are not provided at the ends and the transfer belt 7 is particularly deteriorated. For this reason, the transfer rollers 6*b* and 6*c* which correspond to the unused photosensitive drums 3 and are not provided at the both ends cannot be rotated by the frictional force between the transfer rollers 6*b* and 6*c* and the transfer belt 7. This causes the irregular wear of these transfer rollers 6 which cannot be rotated, resulting problems such as the shortening of the lifespan and irregular transfer.

The above-described arrangement can prevent the occurrence of these problems by keeping these transfer rollers 6*b* and 6*c* distanced from the transfer belt 7, and thus carry out proper image formation for a long period of time.

Alternatively, the transfer roller 6*b* or the transfer rollers 6*b* and 6*c* may be arranged so as to be lower than the drive roller 71, in order to cause the transfer roller(s) not to be in touch with the transfer belt 7.

Note that, since the transfer roller 6*d* at the end is in the vicinity of the drive roller 71 and at a higher free height, the contact between the transfer roller 6*d* and the transfer belt 7 is kept at a sufficient level, and hence, even without the pressure from the photosensitive drums 3, the transfer roller 6*d* can be rotated more or less properly by the frictional force between the transfer roller 6*d* and the transfer belt 7.

Here, regarding the angle θ (detaching/attaching angle range) between the transfer belt unit 8 in the multicolor mode and transfer belt unit 8 in the monochrome color mode (cf. FIG. 8), the detaching distance between the photosensitive drum 3*b* of the image forming station corresponding to the transfer roller 6*b* unused in the case of the monochrome mode and the transfer belt 7 is set at about 2.5-4 mm. The angle θ differs in accordance with the setting of the detaching distance, and is about 2-3° in the present embodiment.

This angle θ can be arbitrarily set, as long as the detaching distance between the photosensitive drum 3*b* next to the photosensitive drum 3*a* being in touch with the transfer belt unit 7 in the monochrome mode and the transfer belt 7 does not influence on the image to be recorded, and the edges of the transported sheet are not in touch with the photosensitive drum 3*b*.

Further, it is preferable that the angle θ is as small as possible, since the time required for switching the image forming mode is shortened and the sheets can smoothly pass through neighboring functional parts (fixing unit 12 and resist roller 14 in the present embodiment). Further, the angle θ is preferably as small as possible because, in the method of carrying out the transfer by transporting sheets using the transfer belt 7, the sheet transportation may be hindered if the vertical position of the sheet significantly differs according to the modes, on the occasion of detaching the sheet from the transfer belt 7 or supplying the sheet to the transfer belt 7.

Now, the correlations between (i) the detaching distance between the photosensitive drum 3*b* and transfer belt 7 and (ii) the friction between the photosensitive drum 3*b* corresponding to the transfer roller 6*b* and the edge of the sheet or the transfer condition (re-transfer) are shown in the following Table. 1. It is clear from the table that the detaching distance is preferably set within the range of 2.5-4 mm. In the table. 1, "O" indicates "always good", "Δ" indicates "occasionally bad", and "x" indicates "always bad". Further, the basic weight of a typical sheet is within the range of 81-105 g/m$^2$.

TABLE 1

| PHENOMENA | TYPE OF RECORDING MEDIUM | DETACHING DISTANCE (mm) 0.5 | 1 | 1.5 | 2 | 2.5 | 3 | 3.5 | 4 |
|---|---|---|---|---|---|---|---|---|---|
| FRICTION AT REAR EDGE OF THE SHEET | 60–105 g/m$^2$ | X | X | Δ | ○ | ○ | ○ | ○ | ○ |
| | 105–300 g/m$^2$ | X | Δ | ○ | ○ | ○ | ○ | ○ | ○ |
| | OHP | ○ | ○ | ○ | ○ | ○ | ○ | ○ | ○ |
| | ENVELOPE | X | X | X | Δ | ○ | ○ | ○ | ○ |
| TRANSFER CONDITION (RE-TRANSFER) | 60–105 g/m$^2$ | Δ | ○ | ○ | ○ | ○ | ○ | ○ | ○ |
| | 105–300 g/m$^2$ | Δ | ○ | ○ | ○ | ○ | ○ | ○ | ○ |
| | OHP | Δ | ○ | ○ | ○ | ○ | ○ | ○ | ○ |
| | ENVELOPE | Δ | ○ | ○ | ○ | ○ | ○ | ○ | ○ |

Table. 1 shows that, when the distance between the photosensitive drum 3*b* and the transfer belt 7 is not less than 2.5 mm, both the friction at the edge of the sheet and the transfer condition (re-transfer) are good at all times.

Although Table. 1 does not include the results under the conditions that the detaching distance is more than 4 mm, it is assumed that both of the above-mentioned items are good at the conditions of more than 4 mm. However, taking into consideration that the transportation of the sheet from the transfer belt 7 to the next device is disturbed and the image forming device increases in size, it is preferable that the detaching distance is not more than 4 mm.

Next, the following will describe how the detaching/attaching operations of the transfer belt unit 8 are controlled.

To detach the transfer belt 7 from the rotating photosensitive drums 3 on the occasion of switching the image forming mode (multicolor mode to/from monochrome mode), the transfer belt 7 rotating at a predetermined speed is detached from the rotating photosensitive drums 3 rotating at a predetermined speed, and the rotation of the photosensitive drums 3 is stopped after the transfer belt unit 8 is completely descended so that the transfer belt 7 is completely detached from the photosensitive drums 3 (3*b*-3*d*). Note that, the switching of the image forming mode can be done when both the transfer belt 7 and the rotating photosensitive drums 3 do not rotate.

With reference to FIGS. 7-10, an arrangement of the detaching/attaching control section 38 for detaching/attaching the transfer belt unit 8 from/to the photosensitive drums 3 will be described below.

Figure 9:
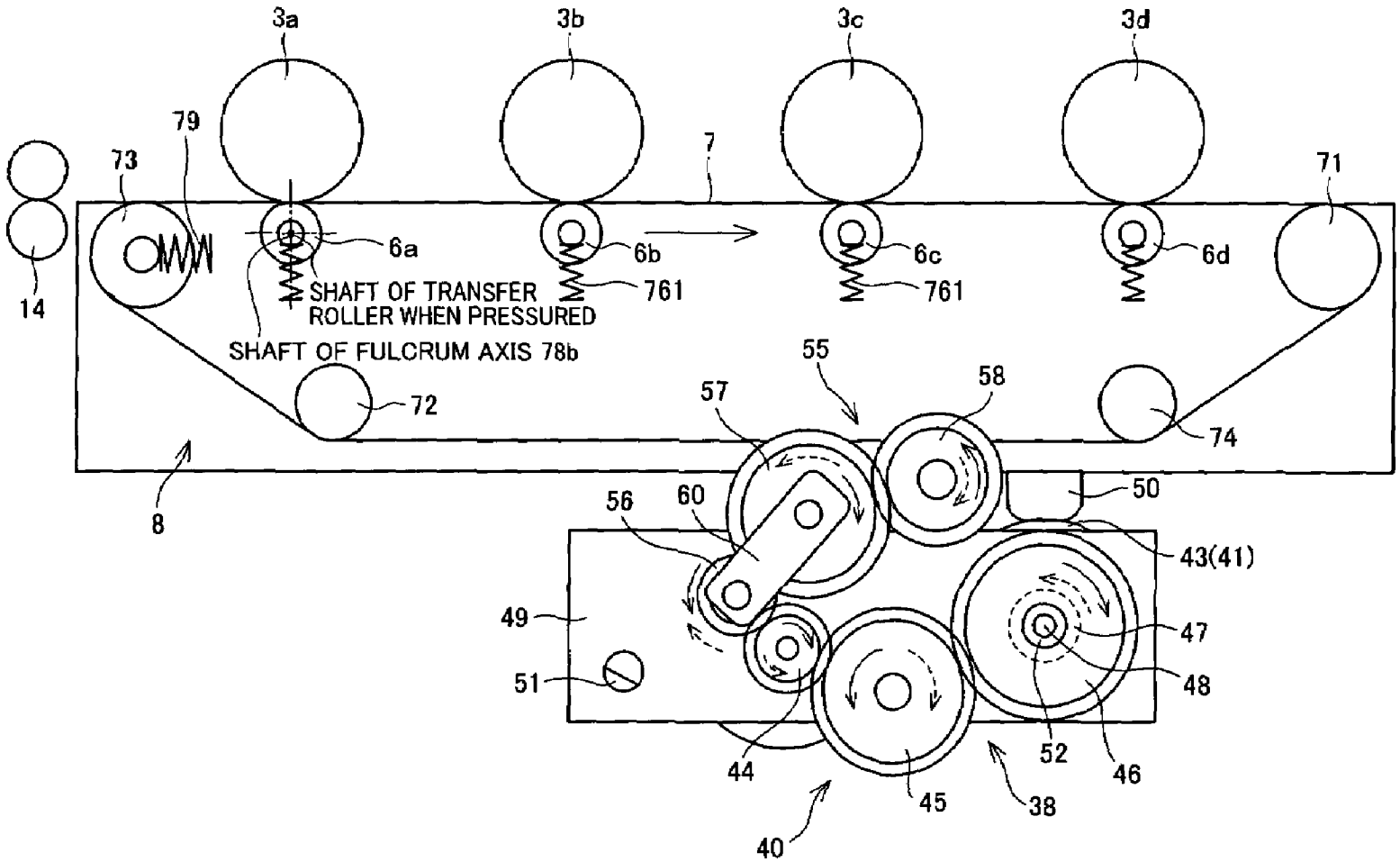
FIG. 9 illustrates the detaching/attaching control section when viewed from the front side of the image forming device.
Figure 10:
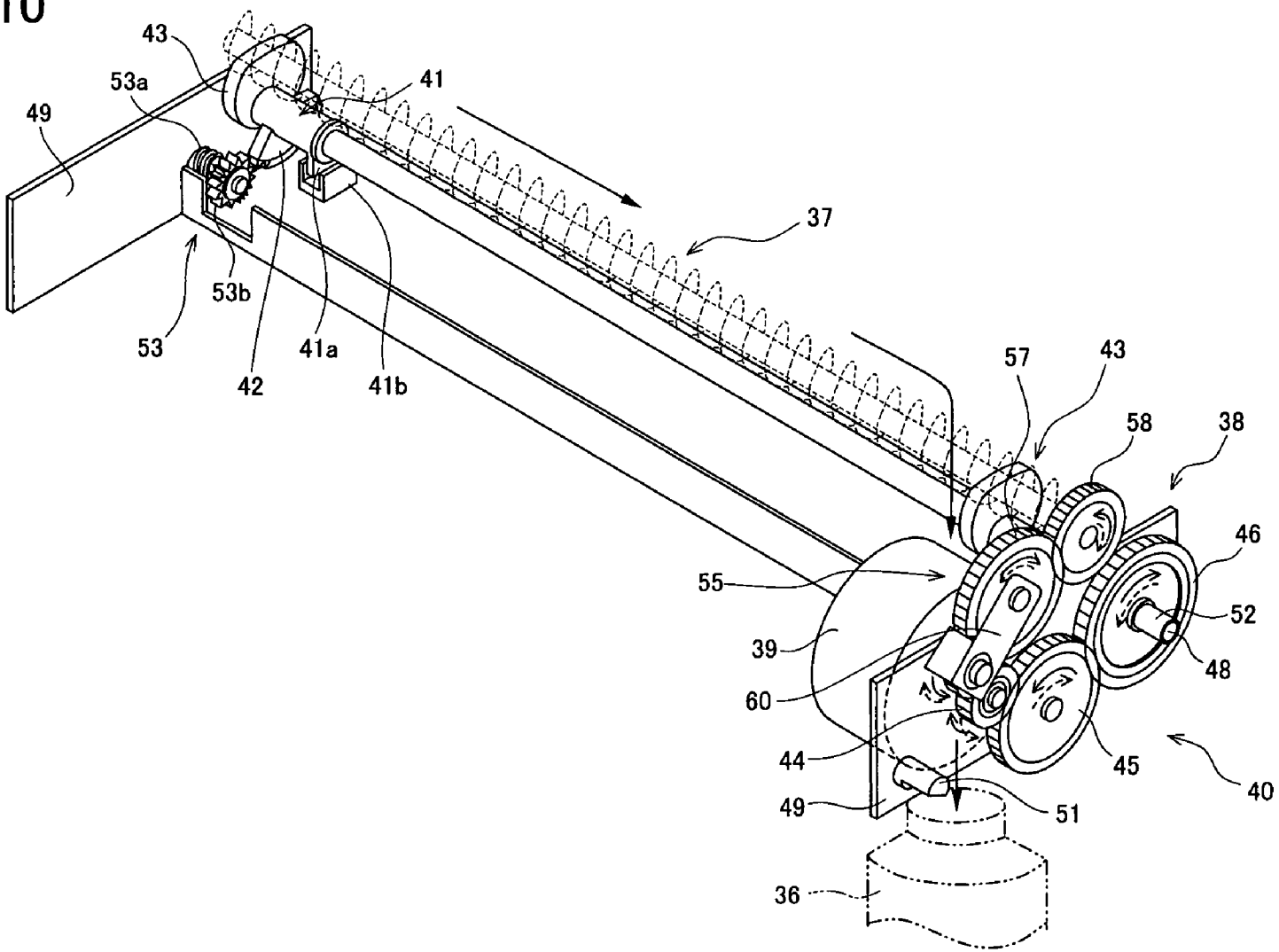
FIG. 10 is a perspective view, illustrating the detaching/attaching control section.

As FIG. 10 illustrates, the detaching/attaching control section 38 includes: a drive source (detaching/attaching drive motor) 39; a gear drive mechanism 40 for transferring power from the drive source 39; and cam-gears 41 which are driven by the gear drive mechanism 40 and include the cam sections 43 with which the holding members 50 (see FIG. 9) fixed to the lower and downstream sides of the transfer belt unit 8 are engaged. Further, between the drive source 39 and gear drive mechanism 40, the frame sections 49 are provided.

The gear drive mechanism 40 is provided on the frame members 49, and includes a drive gear 44 fixed to an output axis of the drive source 39, an intermediate gear 45 engaged with the drive gear 44, and a driven gear 46 engaged with the intermediate gear 45. Note that, instead of the gear drive mechanism 40, a wrapping drive mechanism using members such as a belt and pulley may be adopted.

The driven gear 46 is, as FIG. 9 shows, fitted into the rotation axis 48 with an one-way clutch 47 interposed therebetween the rotating axes 48 are attached to the respective frame members 49 of the main body of the detaching/attaching control section 38 so as to be rotatable, and on the inner sides of the frame members 49, cam-gears 41 are fixed to the respective rotating axes 48.

Figure 7:
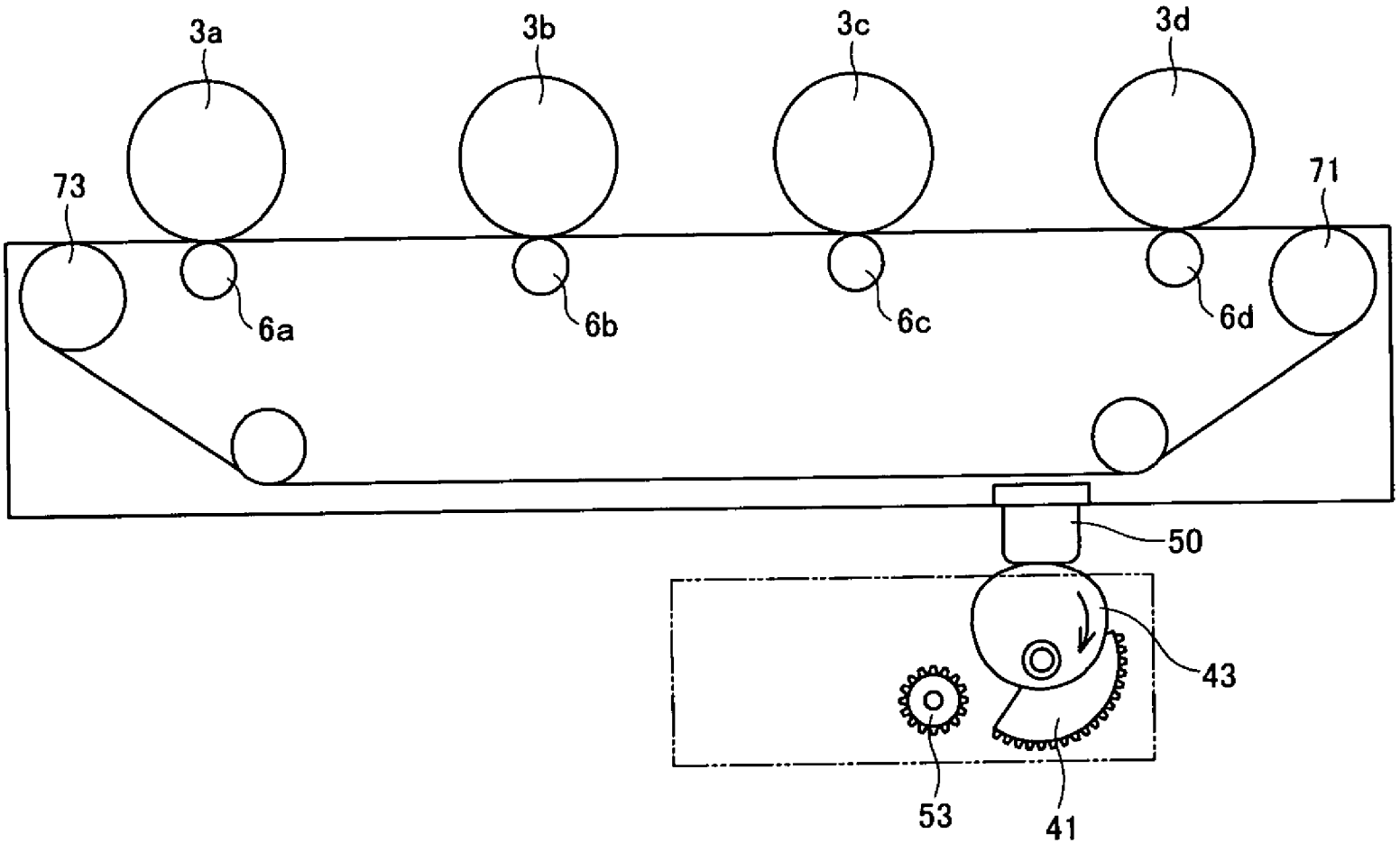
FIG. 7 illustrates the photosensitive drum, transfer belt unit, and a detaching/attaching control section viewed from the rear side, when the multicolor mode is selected.
Figure 8:
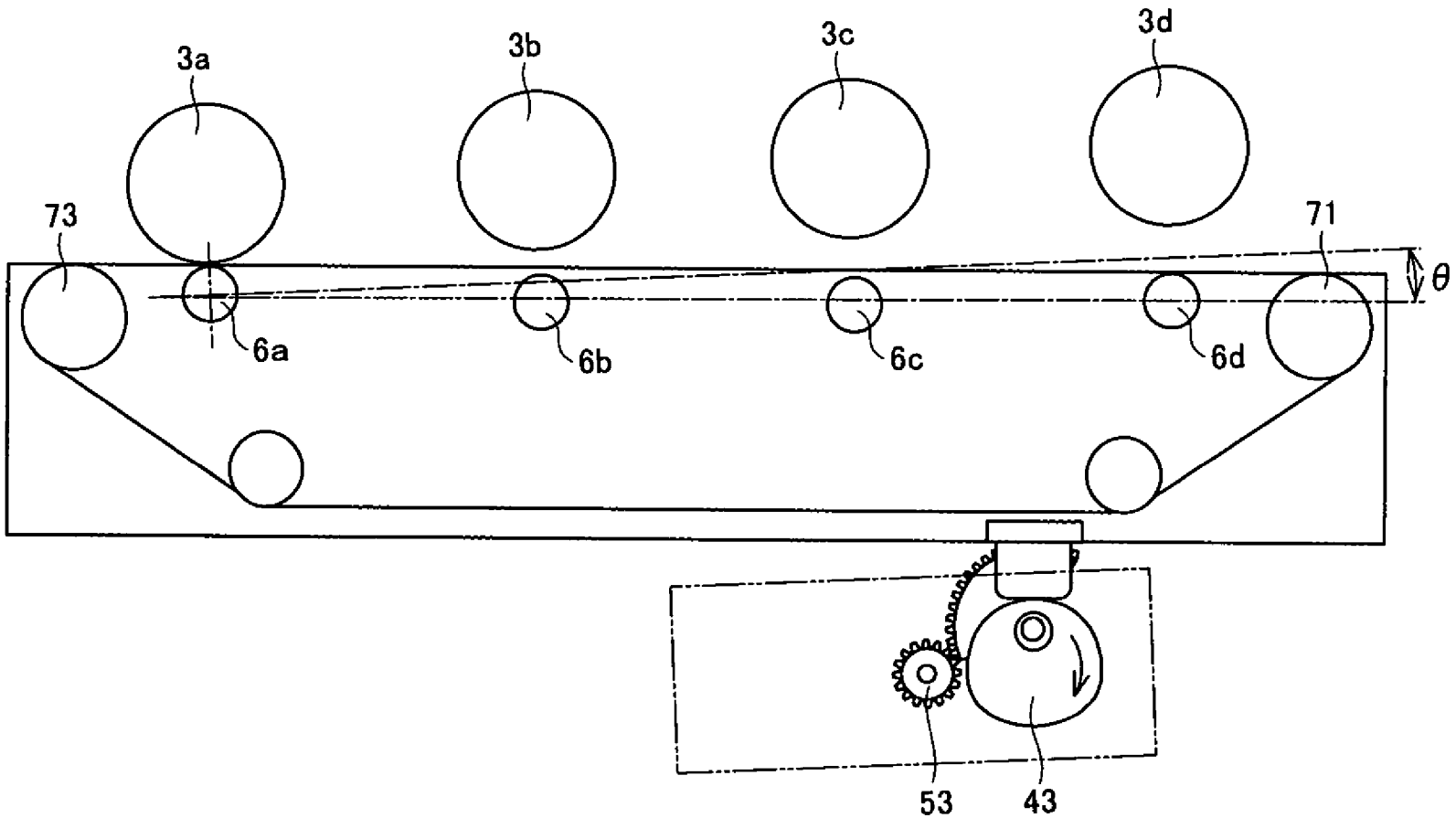
FIG. 8 illustrates the photosensitive drum, transfer belt unit, and detaching/attaching control section viewed from the rear side, when the monochrome mode is selected.

The cam-gears 41 are made of resin such as self-lubricative POM (polyacetal). As FIGS. 7 and 8 show, each of the cam-gear 41 is made of an integrated combination of a fan-shaped partial gear 42 and the cam section 43. A torque limiter 53 engaged with the partial gear 42 is provided on one of the frame members 49, and with the cam sections 43, the holding members 50 (see FIG. 9) fixed to the lower and downstream sides of the transfer belt unit 8 and protruding downward are engaged.

The holding members 50 are provided in the housing 70 of the supporting unit 81 of the transfer belt unit 8, and each being caused to push the transfer belt unit 8, by the elastic member 50*a* made of members such as a compression coil spring (see FIG. 3).

Further, As FIG. 10 illustrates, on the above-mentioned cam-gear 41, a sensor fan 41*a* is formed as an integral part thereof, and this arrangement makes it possible to detect the position of the cam-gear 41 using a detector 41*b* provided on the side of the main body of the image forming device.

The torque limiter 53 shown in FIG. 10 is composed of members such as: two washers having good smoothness, e.g. flat washers (polyslider) made of resin; a compression spring 53*a* provided between the washers; and a brake gear 53*b*. The torque limiter 53 is provided for buffering and regulating the descent of the transfer belt unit 8, and keeping the position of the transfer belt unit 8 to be stable at the bottom limit.

The cam-gear 41 is torqued to 6.5 kgfcm at the rotating axis 48, and the braking force of the torque limiter 53 is set to be 1.2-1.6 kgfcm at the rotating axis 48 of the cam-gear 41.

The braking force is set to be moderate as above, for the reason of preventing the braking force from influencing on the drive source 39. Since the one-way clutch 47 (see FIG. 9) allows the driven gear 46 to turn over in the direction indicated by a full line, the cam-gear 41 is arranged so as to rotate slightly faster than the rotation of the drive source 39, because of the load on the cam section 43.

With the arrangement above, for instance, in the transfer belt unit 8 which is at the higher position (i.e. in the multicolor mode) and in touch with all of the photosensitive drums 3*a*-3*d* as in FIG. 7, the cam-gear 41 is caused to rotate for 180° by the positive rotation (in the direction indicated by the full line) of the drive source 39. With this operation, as FIG. 8 shows, the transfer belt unit 8 rotates about the axis of the supporting shaft 78*b*, the downstream side of transfer belt unit 8 moves downward, and hence the transfer belt unit 8 is distanced from the photosensitive drums 3*b*-3*d*. Thus, the mode is switched to the monochrome mode with which only the photosensitive drum 3*a* is in touch with the transfer belt unit 8.

On this occasion, the partial gear 42 of the cam-gear 41 is engaged with the brake gear 53*b* of the torque limiter 53, so that the brake force is exerted. With this arrangement, the rotation of the cam-gear 41, which is slightly faster than the rotation of the drive source 39, is buffered and regulated, and the descending movement of the transfer belt unit 8 is buffered, thus the transfer belt unit 8 is smoothly guided to the bottom limit.

When the monochrome mode is set as a default mode, the partial gear 42 is not engaged with the brake gear 53*b* of the torque limiter 53 if the cam section 43 is at the highest position. Meanwhile, if the cam section 43 is at the lowest position, only one tooth of the partial gear 42 is engaged with the brake gear 53*b* of the torque limiter 53 so that a braking force is exerted in order to prevent the transfer belt from being unnecessarily moved when the transfer belt unit 8 is in the default state, and hence the transfer belt 7 is stably kept.

Since the load of the transfer belt unit 8 is imposed toward the rotating axis of the cam-gear 41 (i.e. in the direction vertically below), the force of rotating the cam-gear 41 due to the load of the transfer belt unit 8 is not generated, even if the cam section 43 of the cam-gear 41 is at the highest position (i.e. in the multicolor mode). For this reason, the transfer belt unit 8 is stably kept.

Note that, since stepping motors are adopted to the drive source 39 for performing the above-described detaching/attaching operations of the transfer belt unit 8 and to drive sources for rotating the photosensitive drums 3 and transfer belt 7, open-loop control of the speed and position can be performed precisely, and hence the timings of the operations can be easily and properly determined.

Further, it is particularly noted that, in the present embodiment, the drive force from the drive source 39 is transferred to an auger 37 via a train of gears 55, so that the toner retrieved from the transfer belt 7 by the transfer belt cleaning unit 9 (see FIG. 4) is transported to a toner retrieval container 36.

As FIG. 9 shows, the train of gears 55 is composed of a driving gear 56 engaged with the drive gear 44 of the drive source 39, the intermediate gear 57 engaged with the driving gear 56, and the driven gear 58 attached to one end of the auger 37. The driving gear 56 and intermediate gear 57 are supported by a connecting movable arm 60 attached to the frame member 49, and are always pushed in the direction of approaching each other by a pushing member (not illustrated).

With this arrangement, it is possible to assure the engagement of the driven gear 58 and intermediate gear 57 which vertically move in accordance with the up-and-down movement of the transfer belt unit 8.

In the present embodiment, the load on each of the cam sections 43 of the respective cam-gears 41 is set at 5 kgf, and hence the cam sections 43 of the right and left cam gears 41 are under the load of 10 kgf in total. Further, although the teeth of the partial gear 42 of the cam-gear 41 are provided in the range of 150° of the partial gear 42, this range can be suitably altered in accordance with the design condition.

According to the arrangement above, when the transfer belt unit 8 is descended, the drive force of the drive source 39 which rotates clockwise (in the direction indicated by a dotted arrow in FIG. 10) causes the driven gear 58 to rotate anti-clockwise (in the direction indicated by a dotted arrow in FIG. 10) via the drive gear 44 shown in FIG. 9. Thus, the auger 37 integrated with the driven roller 58 rotates in the same direction, so that the toner having been retrieved from the transfer belt 7 is transported to the toner retrieval container 36. In other words, the drive force of the drive source 39 is also used for driving the auger 37, and hence the drive force of the drive source 39 is effectively used.

The toner is remained on the transfer belt 7 for the reasons such as: the troubles including the paper jam; adhesion of the toner of a patch image directly transferred from the photosensitive drums 3, the patch image being used for an image forming process control carried out for keeping the image quality; and adhesion of the toner flying inside the multicolor image forming device to the transfer belt. Removing the remaining toner at the right time (i.e. on the occasion of switching the image forming mode) makes it possible to obtain high-quality images.

Note that, since, in the present embodiment, the auger 37 is a screw-shaped member, the toner is transported in the direction parallel to the axis of the auger 37. However, there is such an alternative arrangement that, providing blades along the axis, the toner is raked out in the direction orthogonal to the axis. In this case, a simple square bar may be adopted as the auger 37.

When the transfer belt unit 8 is caused to rotate for carrying out the detaching/attaching operations, the auger 37 rotates in the opposite direction. However, since this counter-rotation occurs not frequently and only for a short period of time, the present embodiment is arranged so as to allow the counter-rotation of the auger 37.

When the counter-rotation of the auger 37 is problematic, the driven gear 58 is attached to the rotating axis 48 of the auger 48 with a one-way clutch interposed therebetween. Otherwise, allowing the counter-rotation of the auger 37 is preferable in order to reduce the manufacturing costs of the device.

With the arrangement above, the drive source 39 of the detaching/attaching control section 38 not only detaches/attaches the transfer belt unit 8 (transfer belt 7) from/to the photosensitive drums 3 but also drives the auger 37 and transports the retrieved toner. Thus, the drive force of the drive source is effectively used and hence a good cost/performance ratio can be achieved.

The following will describe power supply to and communication with the transfer belt unit 8, with reference to FIGS. 1, 2, 13, and 14.

The transfer belt unit 8 includes: the drive source such as a stepping motor for rotating the drive roller 71 and driving the transfer belt 7; the detector for performing a process control by detecting the concentration of a test patch formed on the transfer belt 7, in order to keep the quality of the formed image to be good at any time; the detector for detecting a test image formed on the transfer belt in order to work out a compensation value for causing the timing of forming an image on an image forming station to correspond to the formation of an image on an image forming station which is used as a reference, for the sake of forming a high-quality image without color drift in the multicolor mode, by aligning the images on the respective image forming stations with each other (note that, the above-mentioned detector may be used for both for the process control and detection of the test image); the transfer rollers 6 to which a transfer bias is applied from a high-voltage power source (not illustrated); and other roller members such as the tension roller 73 which requires grounding and is in touch with the transfer belt.

Thus, an electric connection is required in order to receive electricity from various kinds of power sources and carry out transmission. To provide this electric connection, as FIGS. 1 and 2 shows, the image forming device is provided with a feeding connector 241 which performs transmission and power supply to the main body of the image forming device.

Meanwhile, the transfer belt unit 8 is provided with the receiving connector 240 on the side of the supporting shaft 78*b*, the side not being moved so much on the occasion of switching the image forming mode, for the sake of transmission and receiving electricity.

The feeding connector 241 is composed of a connector section and connector supporting section. At the connecting supporting section, a slide hole 241*a* whose diameter is larger than the diameter of the slide axis 242 and can be suitably used for the connection is provided. That is to say, since the transfer belt unit 8 tilts in accordance with the switching of the image forming mode, the slide hole 241*a* is provided to correspond to the tilt.

The feeding connector 241 is pushed so as to correspond to the vertical position of the receiving connector 240, by an elastic member 243 composed of members such as a compression coil spring, when the transfer belt unit 8 is in the lower position, i.e. released from the support and in the free state.

When the transfer belt unit 8 is completely inserted into the image forming device, the receiving connector 240 is inserted and connected to the feeding 241, so that the connection completes. (cf. FIG. 1).

Subsequently, the transfer belt unit 8 is pushed upward and pressed onto the positioning means. FIGS. 13 and 14 show the transfer belt unit 8 in this state. FIG. 14 shows the transfer belt unit 8 in the multicolor mode, while FIG. 13 shows the transfer belt unit 8 in the monochrome mode. In the multicolor mode, the feeding connector 241 moves upward in accordance with the movement of the transfer belt unit 8, as indicated by an arrow in FIG. 13.

In the monochrome mode, since the diameter of the slide hole 241*a* is sufficiently longer than the diameter of the slide axis 242, the feeding connector 241 having been moved up can tilt in accordance with the tilt of the transfer belt unit 8, and thus communication and power supply can be properly done at any time.

With this arrangement, since the action of opening/closing the side cover 35 automatically causes the connectors to be connected/disconnected, it is unnecessary to connect/disconnect the connectors, and thus the connecting is always done properly so that maintainability improves and maintenance costs can be reduced.

As a matter of course, the power supply to the transfer belt unit 8 is cut off for safety reasons, when the side cover 35 is opened.

Note that, although in the present embodiment the transfer belt 7 is adopted as a transfer supporter, it is possible to achieve similar effects when a transfer drum is adopted as the transfer supporter, instead of an endless transfer belt.

Further, in addition to the transfer supporter, a transport belt device which only functions as a transporter of the recording material is also substantially identical with the transfer belt, so that such a transport belt device can be implemented as an equivalent of the above-mentioned transfer belt unit 8.

In the present embodiment, the image forming device in which the sheet is supported on the transfer belt 7 and the transfer is carried out directly onto the sheet has been described. However, the present invention is not limited to this arrangement so that the present invention can be applied to, for instance, an intermediate-transfer image forming device in which images formed on photosensitive drums are transferred to an intermediate transfer belt, and after overlaying these images on the intermediate transfer belt, the resultant image is transferred to a transported sheet.

Figure 24:
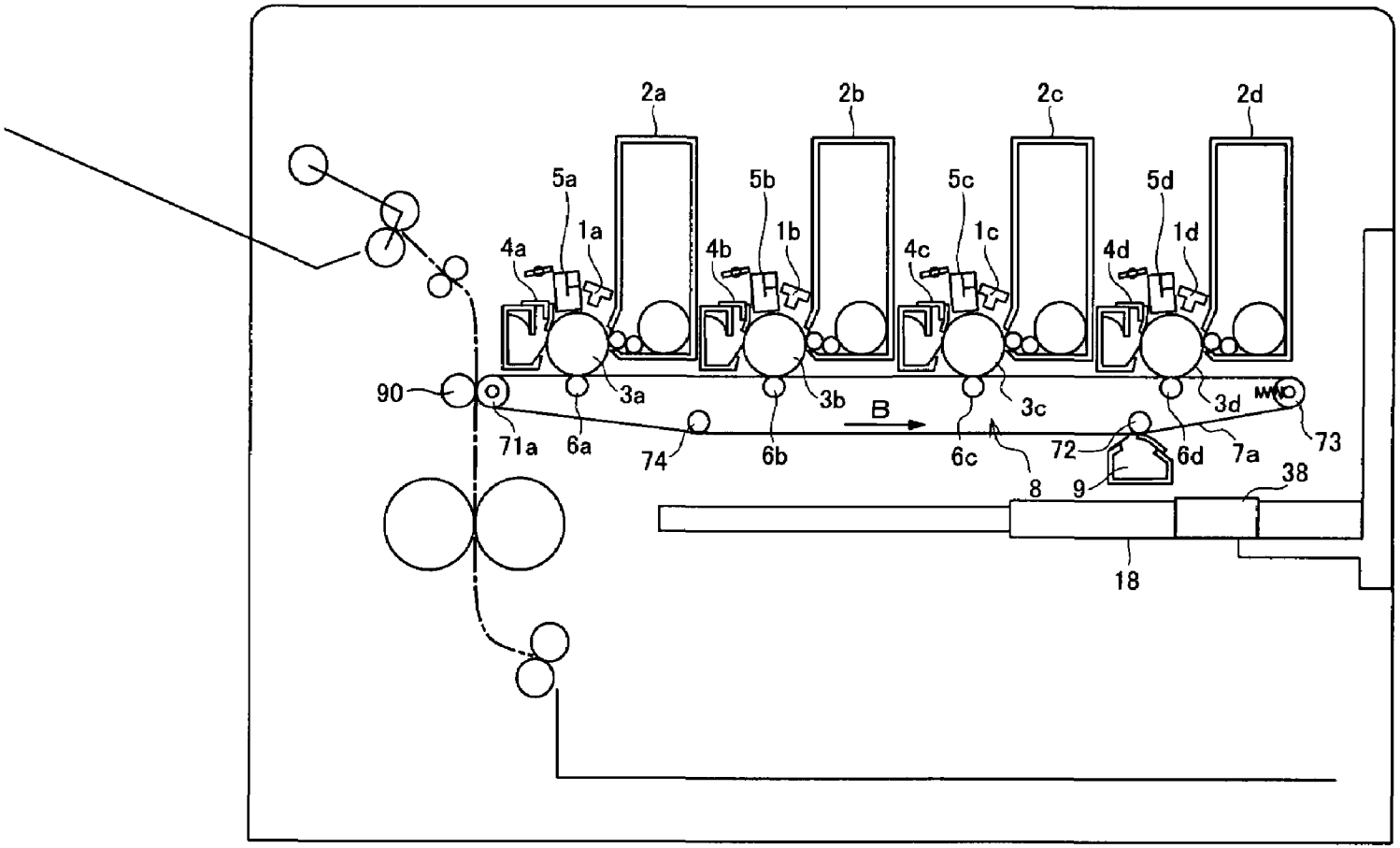
FIG. 24 illustrates a substantial part of an intermediate-transfer image forming device.

FIG. 24 shows such an intermediate-transfer image forming device. In this figure, members having the same functions as those in the image forming device in FIG. 4 are given the same numbers, so that the descriptions are omitted for the sake of convenience.

In this image forming device, an intermediate transfer belt 7*a* is provided in place of the above-mentioned transfer belt 7 in the transfer belt unit 8, and a secondary transfer member (secondary transfer roller) 90 is further provided so as to face a roller member 71*a* which corresponds to the above-mentioned drive roller 71.

After transferring toner images formed on photosensitive drums (image supporters) 3 to the intermediate transfer belt 7*a*, these images are further transferred onto a sheet transported to an interface between the intermediate transfer belt 7*a* and secondary transfer member 90, by the secondary transfer member (transfer roller) 90.

The detaching/attaching mechanism of the present invention is preferably arranged in such a manner that, the holding member includes positioning means for determining a position of the contacting member when the contacting member is in touch with the supporting member, and the holding member supports the contacting member by the positioning means, when the contacting member is in touch with the supporting member.

The detaching/attaching mechanism of the present invention may, for instance, further comprises: a swing-move member which can swing and move in a direction toward the contacting member, wherein, the pushing member includes a slide cam section, and by causing the pushing member to move in one direction, the slide cam section is engaged with the swing-move member so that the swing-move member swings and moves toward the contacting member.

With this arrangement, by causing the pushing member to move in one direction, it is possible to release the support of the contacting member by the holding member, and cause the contacting member to be detached from the supporting member.

Further, preferably, the holding member includes position regulating means for regulating a position of the contacting member with respect to the holding member, when the contacting member is detached from the supporting member, and when the contacting member is detached from the supporting member, the contacting member is provided on the holding member.

According to this arrangement, the contacting member is merely provided on the holding member (i.e. the support by the holding member is released), when the contacting member is detached, and thus the contacting member is in the free state. Thus, it is possible to easily replace the contacting member.

Further, the position regulating means prevents the contacting member from being unnecessarily deviated, when the support and positioning is released so that the contacting member is in the free state.

Further, for instance, since one of the positioning means is arranged so as to face the position regulating means, it is possible to carry out the positioning even in the free state.

The detaching/attaching mechanism of the present invention is preferably arranged in such a manner that, the holding member includes a guiding groove which allows the contacting member to be detachable/attachable.

According to this arrangement, the contact member can be easily replaced. Further, for instance, if the guiding groove has a notch as the position regulating means, the user can "sense" that the contacting member is securely inserted in the detaching/attaching mechanism.

The image forming device of the present invention preferably includes the above-mentioned detaching/attaching mechanism, and from/to an image supporter on which an image is formed in accordance with image data, a transfer supporter device having a transfer supporter for transferring the image is supported so as to be detachable/attachable.

According to this arrangement, it is possible to provide the image forming device in which the transfer supporter device can be detachable/attachable from/to the image supporter or image forming device.

The above-described image display device is preferably arranged in such a manner that, a part of the outer covering of the image forming device is provided in parallel to an axis of a roller member which supports the transfer supporter of the transfer supporter device to be rotatable, and the part of the outer covering is opened in a direction orthogonal to the axis of the roller member.

According to this arrangement, the part of the outer covering is in parallel to one of six sides of the image forming device, except two sides on which the frames (front and rear frames) are provided. Since an opening for detaching/attaching the transfer supporter device is not necessarily formed through one of the frames, the strengths of the frames are not decreased. Given that the strengthening of the frames by, for instance, increasing the thicknesses thereof is unnecessary, it is possible to reduce the weight of the image forming device.

When the outer covering is opened in the direction parallel to the axis of the roller member, the opening has to be large and hence the strengths of the frames are decreased. This problem is particularly conspicuous in the case of a tandem image forming device.

On the contrary, when, with respect to the transfer supporter device, the outer covering is caused to move in the direction orthogonal to the axis of the roller member, the mechanism of supporting and positioning the transfer supporter device with respect to the main body of the image forming device can be downsized, compared to the case of causing the outer covering to move in the direction parallel to the axis of the roller member.

Note that, this direction orthogonal to the axis of the roller member supporting the transfer supporter device is identical with the direction from the upstream to downstream of the sheet transportation.

On this account, when paper jam occurs, a jammed sheet can be easily removed by grabbing a front or rear edge of the sheet and dragging out the sheet toward either the upstream or downstream of the sheet transportation. With this arrangement, it is possible to prevent the following problem: The sheet is torn on the occasion of dragging out so that a small piece of the sheet is remained in an unreachable part of the image forming device.

The above-described image forming device is preferably arranged in such a manner that, the transfer supporter device is detachable/attachable to/from a main body of the image forming device, and is detached/attached from/to the main body when the part of the outer covering is opened.

The transfer supporter device is typically arranged such that at least two frames (front frame and rear frame) are formed orthogonal to the axis of the roller member supporting the transfer supporter, and the roller member is supported by these frames.

According to this arrangement, for instance, the holding member for supporting and positioning the transfer supporter device is formed on the frames, so that the transfer supporter device can move as the holding member is caused to be placed along a guide member. Thus, it is possible to easily detach/attach the transfer supporter device from/to the image forming device.

As a result, the detachment/attachment of the transfer supporter device from/to the image forming device is carried out by causing the transfer supporter device to move in the direction orthogonal to the axis of the roller member supporting the transfer supporter, i.e. in the direction parallel to the frames of the image forming device, through the opening formed by causing the outer covering to move in the same direction. With this arrangement, it is possible to easily detach/attach the transfer supporter device, along the frames.

Since an opening for detaching/attaching the transfer supporter device is not necessarily formed through one of the frames, the strengths of the frames are not decreased. Given that the strengthening of the frames by, for instance, increasing the thicknesses thereof is unnecessary, it is possible to reduce the weight of the image forming device.

The above-mentioned image forming device is preferably arranged in such a manner that, a frame member of a main body of the image forming device has an aligning member which determines a position of the transfer supporter device with respect to a main body of the image forming device, and the aligning member includes position regulating means for preventing deviation of the transfer supporter device.

When the transfer supporter device is unnecessarily deviated, the following problems typically occur: The transfer supporter device is damaged, and the alignment of the transfer supporter device by the aligning member cannot be carried out.

On the contrary, according to the arrangement above, it is possible to prevent the unnecessary deviation of the transfer supporter device, when the support of the transfer supporting device by the position regulating means, for the sake of the positioning, is released and the transfer supporter device is in the free state.

Further, when, for instance, the aligning member has a notch as the position regulating means, the user can "sense" that the transfer supporter device is securely inserted in the image forming device. The above-mentioned image forming device is preferably arranged in such a manner that, a frame member of a main body of the image forming device includes a rail member which guides the transfer supporter device when the transfer supporter device is detached/attached from/to the main body of the image forming device, and the rail member includes: a plurality of positioning means for determining a position of the transfer supporter device with respect to the main body; and position regulating means for preventing deviation of the transfer supporter device with respect to the rail member, when a part of an outer covering of the image forming device is opened.

According to this arrangement, it is possible to prevent the unnecessary deviation of the transfer supporter device, when the support of the transfer supporting device by the position regulating means, for the sake of the positioning, is released and the transfer supporter device is in the free state.

Further, when, for instance, the positioning means is a notch, the user can "sense" that the transfer supporter device is securely inserted in the image forming device.

The above-mentioned image forming device is preferably arranged in such a manner that, the position regulating means is a notch which is provided so as to face at least either one of the plurality of positioning means and regulates deviation of an axis of a roller member which supports the transfer supporter to be rotatable.

According to this arrangement, even when the transfer supporter device is in the free state, the notch prevents the transfer supporter device from moving out from a predetermined area. Further, since the notch faces the positioning means, the deviation of the transfer supporter device is prevented when the positioning of the transfer supporter device is determined, and hence the positioning can be easily carried out.

Moreover, on the occasion of inserting the transfer supporter device along the rail member, the notch enables the user to "sense" that the transfer supporter device is securely inserted in the image forming device.

It is preferable that the above-mentioned image forming device further comprises a blocking member (i) which is engaged with an image supporter unit including the image supporter, when the transfer supporter is in touch with the image supporter, but (ii) which is released from engagement with the image supporter unit and caused to move in accordance with an action of opening/closing the outer covering, when the transfer supporter is not in touch with the image supporter.

With this arrangement, the blocking member prevents the image supporter unit from being drawn out from the image forming device, when the transfer supporter is in contact with the image supporter. Further, it is possible to prevent the occurrence of the following problem: The image supporter unit is mistakenly drawn out even if the transfer supporter is still in contact with the image supporter, so that the surface of the image supporter and the surface of the transfer supporter are damaged.

The above-mentioned image forming device is preferably arranged in such a manner that, a plurality of image supporters are provided in a direction orthogonal to the axis of the roller member which supports the transfer supporter to be rotatable.

A so-called tandem image forming device, in which a plurality of image supporters are provided in the direction orthogonal to the axis of the roller member supporting the transfer supporter, typically has such a feature that the transfer supporter device is large, especially in the direction of the movement of the transfer supporter in the transfer supporter device.

However, according to the arrangement above, the transfer supporter device is caused to move in the direction orthogonal to the axis of the roller member, so that the transfer supported device is detached from or attached to the main body of the image forming device. Thus, it is possible to carry out the detachment/attachment of the transfer supporter device through a small opening.

Further, the foregoing arrangement makes it possible to restrain the decrease of the strengths of the frames of the image forming device, compared to the arrangement that the transfer supporter device is caused to move in the direction parallel to the axis of the roller member supporting the transfer supporter. In addition to the above, it is also unnecessary to form a large opening through the frame in order to detach/attach the transfer supporter device, when the frames are provided in the direction orthogonal to the axis of the roller member supporting the transfer supporter, i.e. in the direction of the movements of the transfer supporter and recording medium. Thus, given that the strengthening of the frames by, for instance, increasing the thicknesses thereof is unnecessary, it is possible to reduce the weight of the image forming device.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A detaching/attaching mechanism in which a contacting member is supported so as to be detachable/attachable from/to a supporting member, comprising:

a holding member which supports the contacting member;

a pushing member which pushes the contacting member via the holding member, in a direction toward the supporting member, in order to cause the contacting member to be in touch with the supporting member, by causing the pushing member to move in one direction, support of the contacting member by the holding member being released so that the contacting member is caused to be detached from the supporting member, wherein, the holding member includes position regulating means for regulating a position of the contacting member with respect to the holding member, when the contacting member is detached from the supporting member, and when the contacting member is detached from the supporting member, the contacting member is provided on the holding member; and a slide section, which is slidable with respect to a main body of an image forming device, includes a part of an outer covering and the pushing member, and an opening is formed in the main body and the contacting member is detached from the supporting member by sliding the slide section, wherein the contacting member is supported inside the main body when a part of the outer covering is opened, wherein the slide section is provided with a member which causes the contacting member to contact the supporting member when the part of the outer covering is closed, and wherein when the part of the outer covering is opened, the contacting member is detached from the supporting member by operation of the member of the slide section.

2. The detaching/attaching mechanism as defined in claim 1, wherein, the holding member includes positioning means for determining a position of the contacting member when the contacting member is in touch with the supporting member, and the holding member supports the contacting member by the positioning means, when the contacting member is in touch with the supporting member.

3. The detaching/attaching mechanism as defined in claim 1, further comprising:

a swing-move member which can swing and move in a direction toward the contacting member, wherein, the pushing member includes a slide cam section, and by causing the pushing member to move in one direction, the slide cam section is engaged with the swing-move member so that the swing-move member swings and moves toward the contacting member.

4. The detaching/attaching mechanism as defined in claim 1, wherein, the holding member includes a guiding groove which allows the contacting member to be detachable/attachable.

5. The detaching/attaching mechanism of claim 1, wherein the pushing member pushes the contacting member via the holding member when the position regulating means regulates the position of the contacting member to a final or locked position.

6. An image forming device including a detaching/attaching mechanism by which a transfer supporter is supported so as to be detachable/attachable from/to an image supporter, the detaching/attaching mechanism including:

a holding member which contacts an image supporter on which an image is formed in accordance with image data, so as to support the transfer supporter which transfer the image;

a pushing member which pushes the transfer supporter toward the image supporter via the holding member, in order to cause the transfer supporter to be in touch with the image supporter, by causing the pushing member to move in one direction, support of the contacting member by the holding member is released so that the contacting member is caused to be detached from the supporting member, wherein, the holding member includes position regulating means for regulating a position of the contacting member with respect to the holding member, when the contacting member is detached from the supporting member, and when the contacting member is detached from the supporting member, the contacting member is provided on the holding member; and a slide section, which is slidable with respect to a main body of the image forming device, includes a part of an outer covering and the pushing member, and an opening is formed in the main body of the image forming device and the contacting member is detached from the supporting member by sliding the slide section, wherein the contacting member is supported inside the main body when a part of the outer covering is opened, wherein the slide section is provided with a member which causes the contacting member to contact the supporting member when the part of the outer covering is closed, and wherein when the part of the outer covering is opened, the contacting member is detached from the supporting member by operation of the member of the slide section.

7. An image forming device, comprising:

an image supporter on which an image is formed in accordance with image data;

a transfer supporter device including a transfer supporter which is detachable/attachable from/to the image supporter and transfers the image by contacting the image supporter, the transfer supporter device being detached from the image supporter by performing an action of opening a part of an outer covering the image forming device, wherein a frame member of a main body of the image forming device includes a rail member which guides the transfer supporter device when the transfer supporter device is detached/attached from/to the main body of the image forming device, and the rail member includes: a plurality of positioning means for determining a position of the transfer supporter device with respect to the main body; and position regulating means for preventing deviation of the transfer supporter device with respect to the rail member, when a part of an outer covering of the image forming device is opened; and a slide section, which is slidable with respect to a main body of the image forming device, includes a part of an outer covering and the pushing member, and an opening is formed in the main body of the device and the contacting member is detached from the supporting member by sliding the slide section, wherein the transfer supporter device is supported inside the main body when a part of the outer covering is opened, wherein the slide section is provided with a member which causes the transfer supporter device to contact the image supporter when the part of the outer covering is closed, and wherein when the part of the outer covering is opened, the transfer supporter device is detached from the image supporter by operation of the member of the slide section.

8. The image forming device as defined in claim 7, wherein, the part of the outer covering of the image forming device is provided in parallel to an axis of a roller member which supports the transfer supporter of the transfer supporter device to be rotatable, and the part of the outer covering is opened in a direction orthogonal to the axis of the roller member.

9. The image forming device as defined in claim 7, wherein, the transfer supporter device is detachable/attachable to/from a main body of the image forming device, and is detached/attached from/to the main body when the part of the outer covering is opened.

10. The image forming device as defined in claim 7, wherein, a frame member of a main body of the image forming device has an aligning member which determines a position of the transfer supporter device with respect to a main body of the image forming device, and the aligning member includes position regulating means for preventing deviation of the transfer supporter device.

11. The image forming device as defined in claim 7, wherein, the position regulating means is a notch which is provided so as to face at least either one of the plurality of positioning means and regulates deviation of an axis of a roller member which supports the transfer supporter to be rotatable.

12. The image forming device as defined in claim 7, further comprising a blocking member (i) which is engaged with an image supporter unit including the image supporter, when the transfer supporter is in touch with the image supporter, but (ii) which is released from engagement with the image supporter unit and caused to move in accordance with an action of opening/closing the outer covering, when the transfer supporter is not in touch with the image supporter.

13. An image forming device, comprising:

an image supporter on which an image is formed in accordance with image data; and a transfer supporter device including a transfer supporter which is detachable/attachable from/to the image supporter and transfers the image by contacting the image supporter, support of the transfer supporter device with respect to a main body of the image forming device being released by performing an action of opening a part of an outer covering of the image forming device, wherein a frame member of a main body of the image forming device includes a rail member which guides the transfer supporter device when the transfer supporter device is detached/attached from/to the main body of the image forming device, and the rail member includes: a plurality of positioning means for determining a position of the transfer supporter device with respect to the main body; and position regulating means for preventing deviation of the transfer supporter device with respect to the rail member, when a part of an outer covering of the image forming device is opened, wherein the transfer supporter device is supported inside the main body when a part of the outer covering is opened, wherein a slide section, for opening the part of the outer covering, is provided with a member which causes the transfer supporter device to contact the image supporter when the part of the outer covering is closed, and wherein when the part of the outer covering is opened, the transfer supporter device is detached from the image supporter by operation of the member of the slide section.

14. The image forming device as defined in claim 13, wherein, the part of the outer covering of the image forming device is provided in parallel to an axis of a roller member which supports the transfer supporter of the transfer supporter device to be rotatable, and the part of the outer covering is opened in a direction orthogonal to the axis of the roller member.

15. The image forming device as defined in claim 13, wherein, the transfer supporter device is detachable/attachable to/from a main body of the image forming device, and is detached/attached from/to the main body when the part of the outer covering is opened.

16. The image forming device as defined in claim 13, wherein, a frame member of a main body of the image forming device has an aligning member which determines a position of the transfer supporter device with respect to a main body of the image forming device, and the aligning member includes position regulating means for preventing deviation of the transfer supporter device.

17. The image forming device as defined in claim 13, wherein, the position regulating means is a notch which is provided so as to face at least either one of the plurality of positioning means and regulates deviation of an axis of a roller member which supports the transfer supporter to be rotatable.

18. The image forming device as defined in claim 13, further comprising a blocking member (i) which is engaged with an image supporter unit including the image supporter, when the transfer supporter is in touch with the image supporter, but (ii) which is released from engagement with the image supporter unit and caused to move in accordance with an action of opening/closing the outer covering, when the transfer supporter is not in touch with the image supporter.

19. An image forming device, comprising:

at least one image supporter on which an image is formed in accordance with image data;

a transfer supporter device including a transfer supporter which is detachable/attachable from/to said at least one image supporter and transfers the image by contacting the image supporter, wherein, detachment/attachment of the transfer supporter device from/to a main body of the image forming device is caused by movement of the transfer supporter device in a direction orthogonal to an axis of a roller member which supports the transfer supporter to be rotatable, wherein a frame member of a main body of the image forming device includes a rail member which guides the transfer supporter device when the transfer supporter device is detached/attached from/to the main body of the image forming device, and the rail member includes: a plurality of positioning means for determining a position of the transfer supporter device with respect to the main body; and position regulating means for preventing deviation of the transfer supporter device with respect to the rail member, when a part of an outer covering of the image forming device is opened; and a slide section, which is slidable with respect to a main body, includes a part of an outer covering and the pushing member, and an opening is formed in the main body and the contacting member is detached from the supporting member by sliding the slide section, wherein the transfer supporter device is supported inside the main body when a part of the outer covering is opened, wherein the slide section is provided with a member which causes the transfer supporter device to contact the at least one image supporter when the part of the outer covering is closed, and wherein when the part of the outer covering is opened, the transfer supporter device is detached from the image supporter by operation of the member of the slide section.

20. The image forming device as defined in claim 19, wherein, a plurality of said at least one image supporter is provided in a direction orthogonal to the axis of the roller member.

* * * * *